US008186976B2

(12) United States Patent
Lund

(10) Patent No.: US 8,186,976 B2
(45) Date of Patent: May 29, 2012

(54) COMBINATION COMPRESSOR AND VACUUM PUMP APPARATUS AND METHOD OF USE

(75) Inventor: Morten A. Lund, Vista, CA (US)

(73) Assignee: US Airflow, Vista, CA (US)

( * ) Notice: Subject to any disclaimer, the term of this patent is extended or adjusted under 35 U.S.C. 154(b) by 1106 days.

(21) Appl. No.: 11/983,476

(22) Filed: Nov. 8, 2007

(65) Prior Publication Data

US 2008/0170953 A1 Jul. 17, 2008

Related U.S. Application Data

(60) Provisional application No. 60/857,677, filed on Nov. 8, 2006, provisional application No. 60/923,978, filed on Apr. 17, 2007.

(51) Int. Cl.
*F04B 23/06* (2006.01)

(52) U.S. Cl. ..... 417/523; 417/199.1; 417/521; 417/545; 92/215

(58) Field of Classification Search ..... 417/199.2, 417/521, 523, 545, 273, 547; 92/110, 118, 92/119, 215

See application file for complete search history.

(56) References Cited

U.S. PATENT DOCUMENTS 722,240 A * 3/1903 Millspaugh ..... 417/486
1,938,826 A * 12/1933 Frank ..... 92/215
3,752,604 A * 8/1973 Dorn ..... 417/511
4,373,876 A 2/1983 Nemoto
4,667,475 A * 5/1987 Wesman ..... 60/537
4,709,790 A * 12/1987 Freitag et al. ..... 188/300
5,050,892 A 9/1991 Kawai et al.
5,467,687 A 11/1995 Habegger
5,531,575 A * 7/1996 Lin ..... 417/526
5,702,239 A * 12/1997 Yang ..... 417/512
6,132,181 A 10/2000 McCabe
6,428,290 B1 * 8/2002 Wang ..... 417/468
6,655,935 B2 12/2003 Bennitt et al.
6,776,589 B2 8/2004 Tomell et al.
2002/0061251 A1 5/2002 McCabe

* cited by examiner

*Primary Examiner* — Devon C Kramer
*Assistant Examiner* — Philip Stimpert
(74) *Attorney, Agent, or Firm* — Mind Law Firm; Jeroyme V. Sartain; Justin G. Sanders

(57) ABSTRACT

A combination compressor and vacuum pump apparatus comprising a common drive mechanism, a compressor piston-cylinder unit mechanically coupled to the drive mechanism, the compressor piston-cylinder unit comprising a hollow first piston rod connected to the drive mechanism at a first free end substantially opposite a first piston operable within a first cylinder so as to form the compressor piston-cylinder unit, and a vacuum pump piston-cylinder unit mechanically coupled to the drive mechanism, the vacuum pump piston-cylinder unit comprising a hollow second piston rod connected to the drive mechanism at a second free end substantially opposite a second piston operable within a second cylinder so as to form the vacuum pump piston-cylinder unit, whereby air is pulled into the compressor piston-cylinder unit through the first piston rod for compression therein and air is exhausted from the vacuum pump piston-cylinder unit through the second piston rod.

12 Claims, 21 Drawing Sheets

COMBINATION COMPRESSOR AND VACUUM PUMP APPARATUS AND METHOD OF USE

RELATED APPLICATIONS

This application claims priority and is entitled to the filing date of U.S. Provisional application Ser. No. 60/857,677 filed Nov. 8, 2006, and entitled "Combination Compressor and Vacuum Pump Apparatus and Method of Use" and U.S. Provisional application Ser. No. 60/923,978 filed Apr. 17, 2007, and entitled "Compression Apparatus and Method of Use." The contents of the aforementioned applications are incorporated by reference herein.

INCORPORATION BY REFERENCE

Applicant hereby incorporates herein by reference any and all U.S. patents and U.S. patent applications cited or referred to in this application, including but not limited to the above-mentioned U.S. Provisional applications to which a priority claim has been made, International patent application Ser. No. PCT/US2005/018142 filed on May 23, 2005, and entitled "Air Compression Apparatus and Method of Use," the two U.S. Provisional patent applications to which the above-referenced PCT application claims priority, namely, U.S. Provisional application Ser. No. 60/573,250 filed May 21, 2004, and entitled "Multi-Stage Compressor with Integrated Internal Breathing" and U.S. Provisional application Ser. No. 60/652,694 filed Feb. 14, 2005, and entitled "Compressor with Variable-Speed Pressure Stroke," U.S. Provisional application Ser. No. 60/742,709 filed Dec. 5, 2005, and entitled "Heat Exchange Apparatus and Method of Use," and U.S. Provisional application Ser. No. 60/779,374 filed Mar. 4, 2006, and entitled "Compression Apparatus and Method of Use."

BACKGROUND OF THE INVENTION

1. Field of the Invention

Aspects of this invention relate generally to air compression systems, and more particularly to a combination compressor and vacuum pump apparatus and method of use.

2. Description of Related Art

The following art defines the present state of this field in connection with compressors generally:

Great Britain Patent No. GB 1043195 to Grant describes a reciprocating piston compressor or air motor having a plurality e.g. four cylinders extending radially from an axial valve chamber housing four angularly spaced ports and in which is rotatably mounted an axially adjustable tubular cylindrical distributing valve provided in a central portion with a suction port and a delivery port and adapted to be brought into sequential communication with each valve chamber port, the outer surface of the valve body is provided with a groove which at or immediately prior to opening of delivery port serves to connect the valve chamber port to an annular chamber bounded in part by the drive end of the valve body and the pressure therein acts against the discharge pressure in an annular chamber at the other end of said valve body and the resulting axial displacement of the valve controls the time of opening of the valve ports according to whether the pressure in one chamber is below or above that in another chamber. The valve portion comprises concentric tubes connected by webs and through which the suction port extends whilst the delivery port extends through the outer tube only. An axial extension tube provides air inlet means to said suction port.

Each of the four valve chamber ports are roughly triangular and have a side parallel to the valve axis, a side normal to the axis and the third side has two portions of differing slopes which register with portions of the leading edge of the inlet port and with the leading edge of the delivery port. Lubricant is admitted to a bore leading to grooves and cooling water admitted through a pipe traverses a jacket surrounding the valve and a space round each cylinder. The pistons are each secured to a cross-head connected together in diametrically opposed pairs by the outside member whilst adjacent pistons are connected by connecting members and the cross-heads are reciprocated by two eccentric rings each rotatable within a slide block and having secured thereto a dished disc. The latter are secured together at their peripheries by bars and have balancing weights.

Great Britain Patent No. GB 1259755 to Sulzer Brothers Ltd. describes a compressor wherein a piston reciprocates in a cylinder without normally making physical contact with the cylinder, the piston being provided with a split ring having longitudinal grooves in its periphery. The ring may be of P.T.F.E. and acts to guide the piston in the event of abnormal operation causing the piston to approach the cylinder. During normal operation gas escaping past labyrinth seals or labyrinths formed in the periphery of the piston, acts on a conical ring to centre the piston. Radial holes pass through the ring and open into the grooves thereby to provide pressure equalization between the inside and outside of the ring. The piston may be double or, as shown, single acting and driven by a piston rod which extends through a cylinder seal for connection to a cross-head.

U.S. Pat. No. 4,373,876 to Nemoto describes a compressor having a pair of parallel, double-headed pistons reciprocally mounted in respective cylinder chambers in a compressor housing. The pistons are mounted on a crankshaft via Scotch-yoke-type sliders slidably engaged in the respective pistons for reciprocating movement in a direction normal to the piston axis. The sliders convert the rotation of the crankshaft into linear reciprocation of the pistons. The dimensions of these sliders are determined in relation to the other parts of the compressor so that, during the assemblage of the compressor, the sliders may be mounted in position by being passed over the opposite end portions of the crankshaft following the mounting of the pistons and crankshaft within the housing.

U.S. Pat. No. 5,050,892 to Kawai, et al. describes a piston for a compressor comprising a ring groove on the outer circumferential surface of the piston, and a discontinuous ring seal member with opposite split ends made of a plastic material and fitted in the ring groove. The ring member having an outer surface comprising a main sealing portion having an axially uniform shape and an outwardly circumferentially projecting flexible lip portion. Also, the inner surface of the ring member comprises an inner bearing portion able to come into contact with a first portion of a bottom surface of the ring groove such that the flexible lip portion of the outer surface is brought into contact with a cylinder wall of the cylinder bore and preflexed inwardly. An inner pressure receiving portion is formed adjacent to the inner bearing portion to receive pressure from the compression chamber, to further flex the flexible lip portion upon a compression stroke of the compressor and thereby allow the ring member to expand and the main sealing portion to come into contact with the cylinder wall of the cylinder bore.

Japanese Patent Application Publication No. JP 1985/0079585 to Michio, et al. describes a displacer rod bearing body, provided at its upper and lower parts with rod pin mounting parts, and reciprocatively slides a displacer rod bearing surface around a cross rod pin of a cross head. A displacer rod, secured to a displacer, is rotatably supported to an upper rod pin of the bearing body, and a compressor for the displacer is rotatably supported to a lower rod pin.

U.S. Pat. No. 5,467,687 to Habegger describes a piston compressor having at least one cylinder and a piston guided therein in a contact-free manner, which is connected via a piston rod to a crosshead. The piston rod consists of a pipe extending between the crosshead and the piston. In this pipe extends a tension rod, which can be extended by means of a hydraulic stretching device and under prestressing pulls the crosshead and the piston towards the pipe.

U.S. Pat. No. 6,132,181 to McCabe describes a windmill having a plurality of radially extending blades, each being an aerodynamic-shaped airfoil having a cross-section which is essentially an inverted pan-shape with an intermediate section, a leading edge into the wind, and a trailing edge which has a flange doubled back toward the leading edge and an end cap. The blade is of substantial uniform thickness. An air compressor and generator are driven by the windmill. The compressor is connected to a storage tank which is connected to the intake of a second compressor.

U.S. Patent Application Publication No. US 2002/0061251 to McCabe describes a windmill compressor apparatus having multiple double acting piston/cylinders actuated by the windmill. The windmill additionally has multiple pairs of blades to enhance power output and lift.

U.S. Pat. No. 6,655,935 to Bennitt, et al. describes a gas compressor and method according to which a plurality of inlet valve assemblies are angularly spaced around a bore. A piston reciprocates in the bore to draw the fluid from the valve assemblies during movement of the piston unit in one direction and compress the fluid during movement of the piston unit in the other direction and the valve assemblies prevent fluid flow from the bore to the valve assemblies during the movement of the piston in the other direction. A discharge valve is associated with the piston to permit the discharge of the compressed fluid from the bore.

U.S. Pat. No. 6,776,589 to Tomell et al. describes a reciprocating piston compressor having a suction muffler and a pair of discharge mufflers to attenuate noise created by the primary pumping frequency in the primary pumping pulse. The suction muffler is disposed along a suction tube extending between the motor cap and the cylinder head of the compressor. The discharge mufflers are positioned in series within the compressor to receive discharge gases from the compression mechanism and are spaced one quarter of a wavelength from each other so as to sequentially diminish the problematic or noisy frequencies created during compressor operation. The motor/compressor assembly including the motor and compression mechanism is mounted to the interior surface of the compressor housing by spring mounts. These mounted are secured to the housing to define the position of the nodes and anti-nodes of the frequency created in the housing to reduce noise produced by natural frequencies during compressor operation.

In connection with combination compressor and vacuum pump units, more particularly, a typical application of such technology is in connection with an oxygen concentrator or oxygen generator, a device used to provide oxygen therapy to a patient at substantially higher concentrations than those of ambient air and so employed as an alternative to tanks of compressed oxygen. Oxygen concentrators may also provide an economical source of oxygen in industrial processes. The typical oxygen concentrator works off of the principle of Pressure Swing Adsorption (PSA). A PSA concentrator is capable of continuous delivery of oxygen and has internal functions based around two cylinders, or beds, filled with a zeolite material, which selectively adsorb the nitrogen in the air. In each cycle, air is flowed through one cylinder at a pressure of around 20 lbf/in$^2$ (138 kPa or 1.36 atmospheres) where the nitrogen molecules are captured by the zeolite, while the other cylinder is vented off to ambient atmospheric pressure allowing the captured nitrogen to dissipate. Such units typically have cycles of around 20 seconds and allow for a continuous supply of oxygen at a flow rate of up to approximately five liters per minute (LPM) at concentrations anywhere from 50 to 95%. A similar prior art process is known as Vacuum Swing Adsorption (VSA), which uses a single low pressure blower and a valve which reverses the flow through the blower so that the regeneration phase occurs under a vacuum. A still further alternative prior art approach to oxygen concentration employs technology known as Advanced Technology Fractionator (ATF). A rotary distribution valve built into the ATF directs the flow of compressed air to a group of four molecular sieve beds at any given time. Simultaneously, another four beds are allowed to purge to atmosphere through the rotary valve. The remaining four beds are interconnected through the valve to equalize pressure as they transition between adsorbing and desorbing. The combined twelve sieve beds of the ATF device contain about the same amount of molecular sieve as the conventional two-bed oxygen concentrator. In any of the above approaches, a compressor or a combination compressor and vacuum pump may be employed in pressurizing, delivering, and/or purging air within the system as the concentrator operates. A typical such compressor and vacuum pump unit is manufactured and sold by Rietschle Thomas. For example, the WOB-L® Piston design Model 2250 employs a rocker piston arrangement driven by a brushless DC motor offering variable speed from 1,000 to 3,000 RPM, whereby the air flow of the concentrator can be varied according to patient need. In addition, an optional closed loop controller may allow motor speed to be maintained at a pre-set, constant RPM regardless of load or voltage fluctuations. The oil-less piston and cylinder design reduces contaminants in the air flow, and the use of magnesium components minimizes the pump's weight, important features for portable oxygen concentrators.

The prior art described above teaches single and double-acting air cylinders, and specifically combination compressor and vacuum units for use in connection with oxygen concentrators, but does not teach introducing air into or discharging air from an air cylinder through a hollow piston rod or the use of a piston-cylinder arrangement having relatively long-stroke, slow movement to achieve the required pressures and flow rates more efficiently and quietly and with less heat build-up and wear. Aspects of the present invention fulfill these needs and provide further related advantages as described in the following summary.

SUMMARY OF THE INVENTION

Aspects of the present invention teach certain benefits in construction and use which give rise to the exemplary advantages described below.

In a first aspect of the combination compressor and vacuum pump apparatus of the present invention, a compressor piston-cylinder unit comprises a hollow first piston rod connected to a first piston operable within a first cylinder so as to form the compressor piston-cylinder unit, whereby air is pulled into the compressor piston-cylinder unit through the first piston rod for compression therein.

In a second aspect of the present invention, a vacuum pump piston-cylinder unit comprises a hollow second piston rod connected to a second piston operable within a second cylinder so as to form the vacuum pump piston-cylinder unit, whereby air is exhausted from the vacuum pump piston-cylinder unit through the second piston rod.

In a further aspect of the present invention, the compressor piston-cylinder unit and the vacuum pump piston-cylinder unit are mechanically coupled to a common drive mechanism through the respective first and second hollow piston rods.

In a further aspect of the present invention, the first and second pistons comprise an annular piston body formed with at least one circumferential, spaced-apart groove thereabout.

In a still further aspect of the present invention, at least one channel is formed in an outer wall of a piston base sub-assembly, and an o-ring is seated in the at least one channel so as to secure the piston body on the piston base sub-assembly in a rooted fashion, whereby side load during operation of the piston within the cylinder is minimized and centering and even wear are encouraged.

In yet a further aspect of the present invention, the piston base sub-assembly has at least one through-hole, a floating disk valve is installed substantially adjacent to the piston base sub-assembly, the disk valve having at least one groove formed within a surface thereof substantially opposite the piston base-sub-assembly, and an o-ring seated within the at least one groove so as to selectively seal about the at least one through-hole.

In a still further aspect of the present invention, at least one of the piston-cylinder units further comprises a cylinder body having an upper end with a stepped bore formed therein.

In a still further aspect of the present invention, at least one of the piston-cylinder units further comprises a cylinder body having an upper end and a cylinder inside diameter, and an upper cap installed on the cylinder body substantially at the upper end, the upper cap having a cap inside diameter that is larger than the cylinder inside diameter.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

Figure 1:
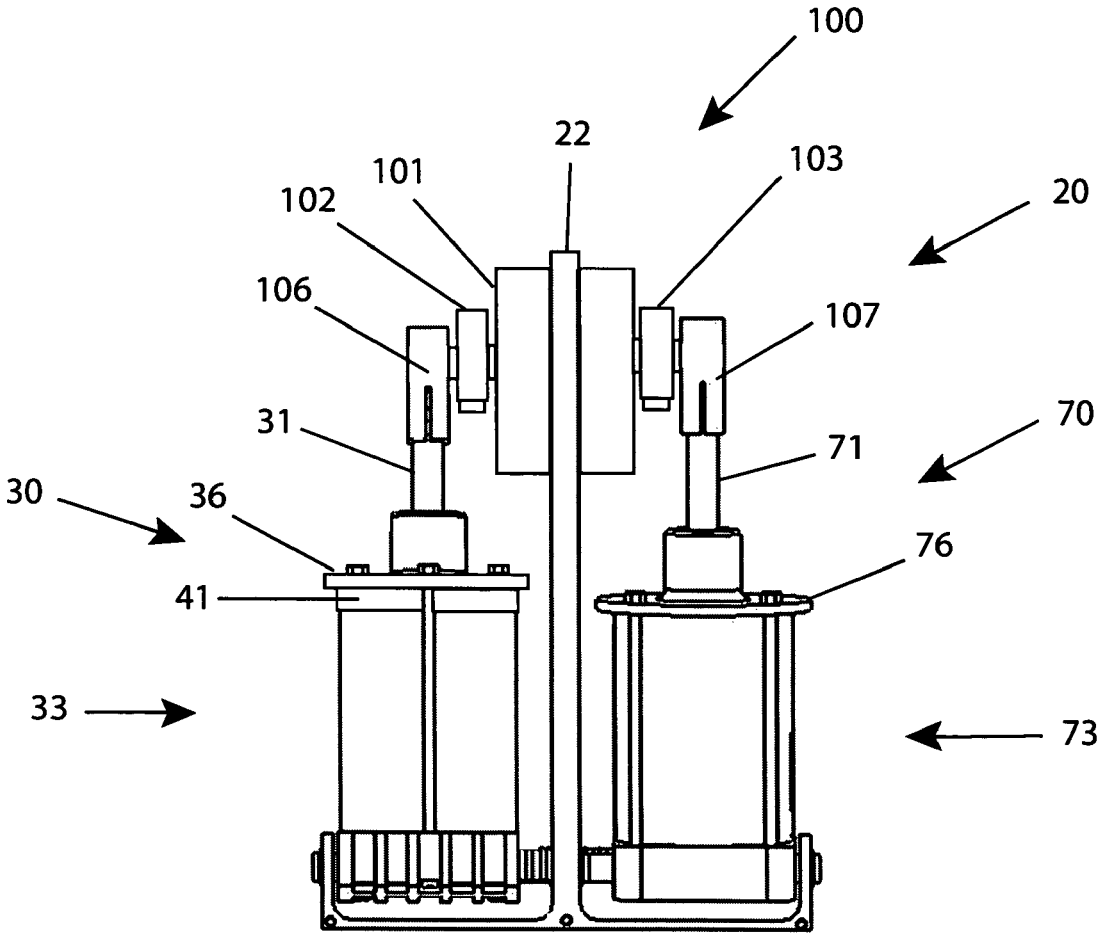
FIG. 1 is a front schematic view of an exemplary embodiment of the invention.

The above described drawing figures illustrate aspects of the invention in at least one of its exemplary embodiments, which are further defined in detail in the following description.

The subject of this patent application is an improved combination compressor and vacuum pump apparatus and method of use that builds on the disclosures of the above applications incorporated herein by reference. Thus, while the further exemplary embodiments shown and described herein are focused on a particular design of a compressor piston-cylinder arrangement and a vacuum pump piston-cylinder arrangement and of a corresponding motor and drive mechanism and other such features, all in the particular context of delivering the air requirements for a portable oxygen concentrator as is used in the health care industry, it will be appreciated by those skilled in the art that the present invention is applicable to or may work in conjunction with any such compression or vacuum system that involves or employs a compressible fluid or medium, whether liquid or gas, and that includes a power source to drive the drive mechanism and other peripheral valves, fixtures and the like not pertinent to the present disclosure, any such apparatus being scalable to suit a variety of applications.

Generally, the compressor and vacuum pump apparatus employs a direct drive brush-less DC motor. The motor also functions as a flywheel storing inertial energy. The motor shaft is connected to a drive arm with a crank pin on both sides of the motor. One side of the motor is driving the compressor and the other is driving the vacuum pump, as explained more fully below. The compressor cylinder has a drive mechanism that reduces piston speed over the top of each stroke, providing improved dynamic movement of the piston and increased leverage and power of the piston itself during the cycle, all with little to no side load on the piston or piston rod. A relatively long stroke, double-acting piston-cylinder arrangement enables further reduced speeds so as to significantly lower inertial and reversal losses in some applications while still meeting pressure and flow rate output requirements. Incorporating the general principles of operation of the various compressor mechanisms disclosed herein and in the above-referenced prior patent applications, the efficiency of the combination compressor and vacuum pump is enhanced through the use of integrated internal breathing of the cylinder, whereby ambient air is drawn into the cylinder via the hollow piston rod and piston valve. Piston ring and inlet and outlet valve designs reduce both blow by and contaminants in the air stream in an oil-less environment. On the upstroke of the compressor, air is drawn through the hollow piston rod down to the piston where the initial vacuum opens the piston valve allowing the air to fill the cylinder. In the exemplary embodiment, at about ¾ of full stroke the air above the piston is forced into the cylinder with a super charged effect. On the down stroke, pressure in the cylinder closes the piston valve, so that the piston compresses the air through the outlet valve, while more air is being drawn into the top chamber of the piston. Similarly, on the vacuum pump side, on the upstroke air is drawn through the bottom cylinder valve by the upward movement of the piston, where the initial vacuum opens the bottom cylinder valve allowing the air to be drawn in via a vacuum from the reaction chamber. Then, on the down stroke, the vacuum in the reaction chamber closes the bottom cylinder valve and the piston valve opens so that the air coming from the cylinder and the air above the piston compresses through the piston rod outlet passages. Again in the exemplary embodiment, at about ¾ of full downward stroke the air above the piston and in the clearance pocket is in a light vacuum state. At the same time the light vacuum helps the initial return stroke of the piston, creating a super charged vacuum. The initial vacuum also assists in keeping the cylinder running cooler. In a double-acting cylinder scenario, the above general principles of operation apply, only air is drawn through the hollow piston rod down to the piston where the vacuum opens either the top or bottom piston valve, depending on where the piston is in its stroke. On the return action, pressure closes the appropriate piston valve, so that the piston compresses the air in one chamber and then pushes the compressed air through an outlet valve, all while more air is being drawn into the opposite chamber on the other side of the piston. Thus, whether single-acting or double-acting, the compressor and vacuum pump apparatus enables more efficient and quiet operation with relatively cleaner and cooler air output. These and other functional advantages of the present invention as employed in the context of a combination compressor and vacuum pump will be appreciated by those skilled in the art. As such, it will be further appreciated that while exemplary embodiments of the combination compressor and vacuum pump apparatus are shown and described, the invention is not so limited.

Referring first to the front view of FIG. 1, the combination compressor and vacuum pump apparatus 20 of the present invention shown and described herein in the exemplary embodiment generally includes a compressor piston-cylinder unit 30 and a vacuum pump piston-cylinder unit 70, both connected to a common drive mechanism 100 so as to shift the respective hollow first and second piston rods 31, 71 and first and second pistons 32, 72 (FIGS. 10 and 17) up and down within the respective first and second cylinders 33, 73 and thereby compress the air or other such compressible medium introduced into the cylinder, or pull such medium through the cylinder in the case of the vacuum pump, employing the various means described in the incorporated references and further below in the illustrative embodiment. The first and second piston rods 31, 71 are shown as being attached at their respective first and second free ends, or ends opposite the pistons 32, 72, to the drive mechanism 100 on offset arms 102, 103 having bearings 104, 105 (FIGS. 2 and 3) or the like press fit within intake blocks 106, 107, best shown in the enlarged perspective view of FIG. 4 for the compressor unit 30, as further shown and described in the incorporated references, for the purpose of introducing air into the cylinder 33 through the hollow piston rod 31 in the case of the compressor unit 30, or in the case of the vacuum pump unit 70, exhausting air from the cylinder 73 through the hollow piston rod 71, more about which is said below.

Figure 2:
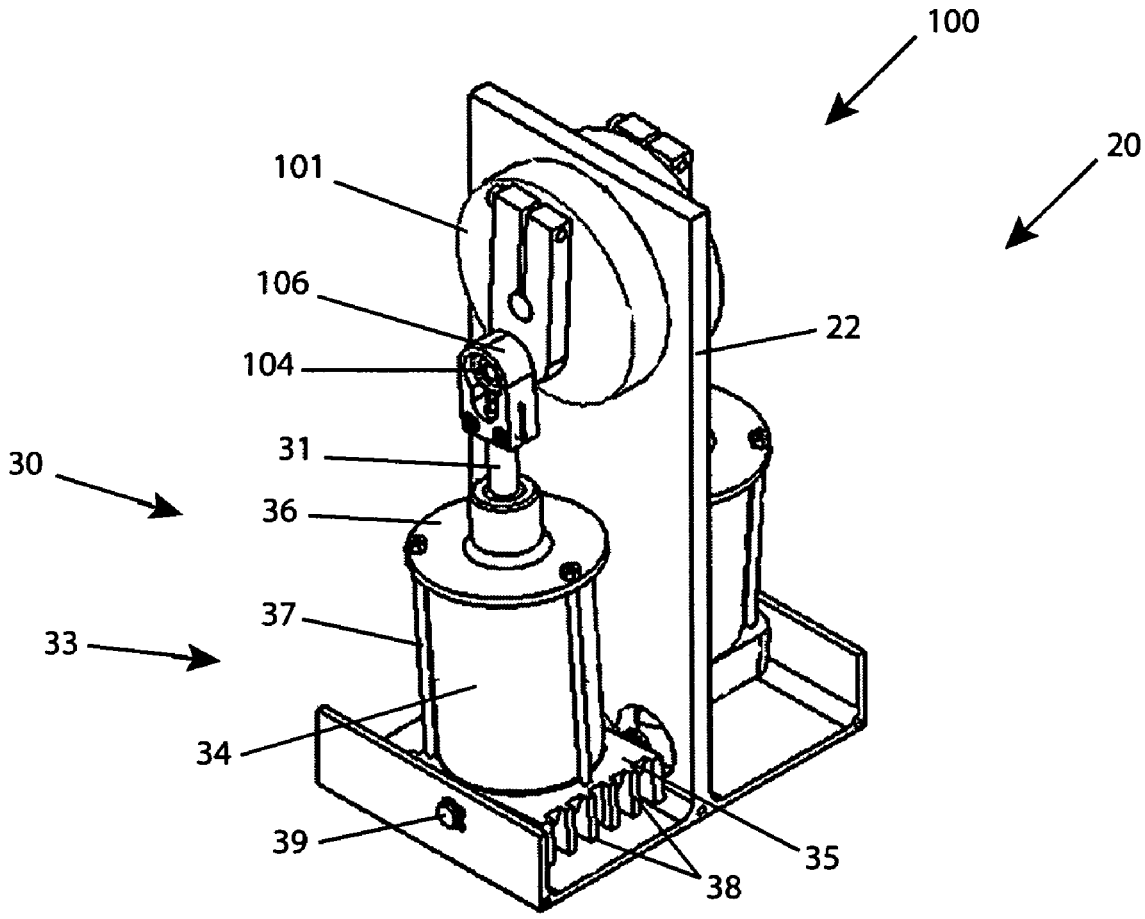
FIG. 2 is a left perspective view thereof.

Turning now to FIG. 2, more specifically, there is shown a left perspective view of the combination compressor and vacuum pump apparatus 20 on which the compressor unit 30 is pivotally installed. Specifically, the compressor unit 30 includes a cylinder 33 having a body 34 mounted on a pivoting base 35 at its lower end and having a cap 36 at its upper end. While the cap 36 is shown as being secured to the base 35 by three tie rods 37, it will be appreciated that both the base 35 and cap 36 can be secured to the cylinder body 34 by any means now known or later developed in the art, including forming at least one of the base 35 or cap 36 integral with the cylinder body 34. As shown, the base 35 may be formed with cooling fins 38 to aid in heat dissipation. The base 35 may be pivotally installed on the frame 22 via one or more pins 39.

Figure 3:
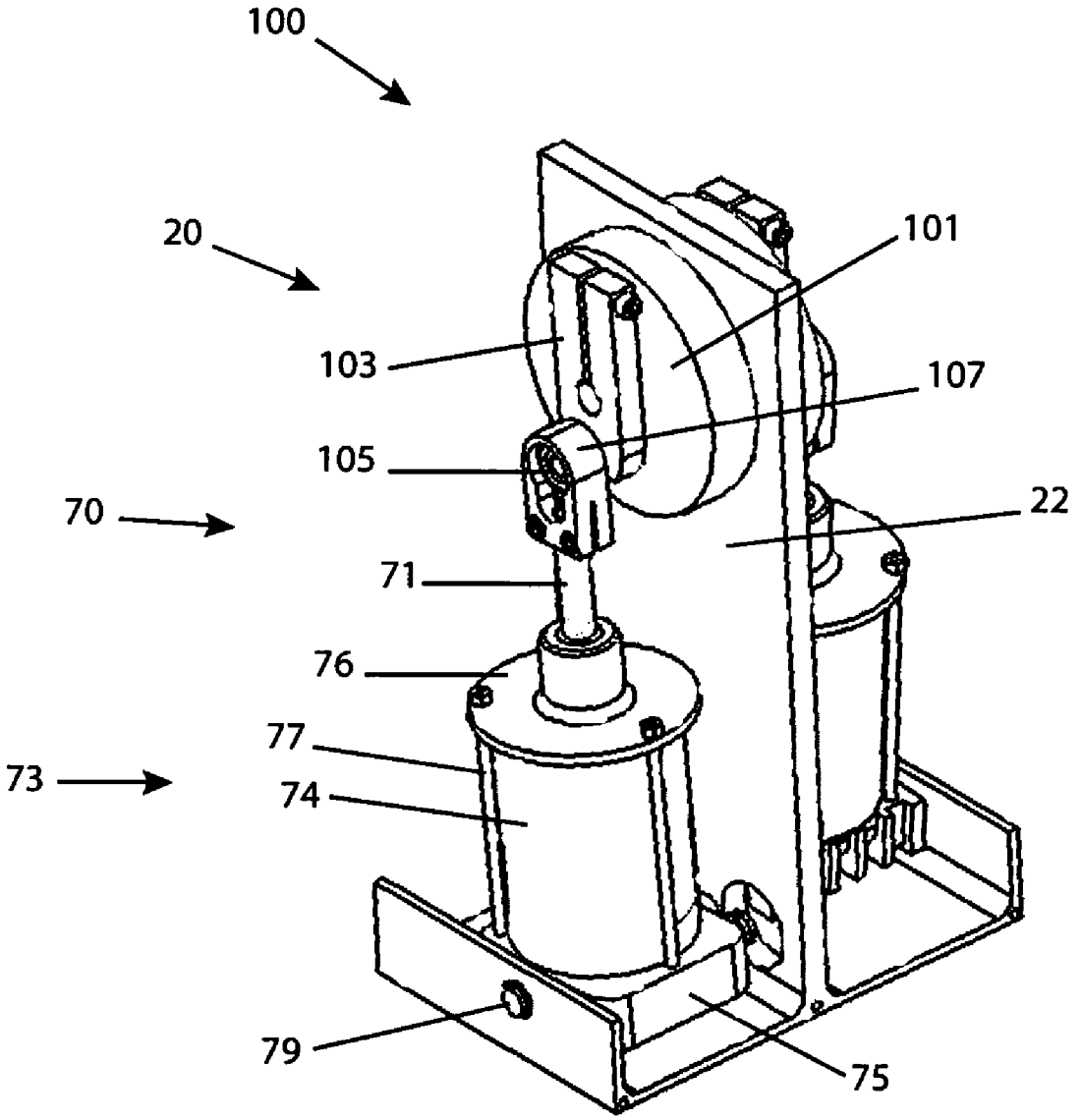
FIG. 3 is a right perspective view thereof.

Turning now to FIG. 3, there is shown a right perspective view of the combination compressor and vacuum pump apparatus 20 on which the vacuum pump unit 70 is pivotally installed. Specifically, the vacuum pump unit 70 includes a cylinder 73 having a body 74 mounted on a pivoting base 75 at its lower end and having a cap 76 at its upper end. While the cap 76 is again shown as being secured to the base 75 by three tie rods 77, it will be appreciated that both the base 75 and cap 76 can be secured to the cylinder body 74 by any means now known or later developed in the art, including forming at least one of the base 75 or cap 76 integral with the cylinder body 74. The base 75 may be pivotally installed on the frame 22 via one or more pins 79. More generally, it will be appreciated that various arrangements of the cylinders 30, 70 beyond that shown and described are possible in the present invention without departing from its spirit and scope.

As seen in both FIGS. 2 and 3, a brushless DC motor 101 is installed in a direct drive arrangement within the frame 22 so as to simultaneously drive both the compressor 30 and the vacuum pump 70. The motor may be custom designed/wound to run most efficiently at 1,000 rpm or less. A microprocessor control (not shown) can react dynamically at speeds of under 1,000 rpm so as to control the speed and torque of the motor 101 during various phases of relative work within the rotational cycle. While a particular drive arrangement and motor is shown and described, it will be appreciated by those skilled in the art that numerous other configurations are possible without departing from the spirit and scope of the invention, depending, in part, on motor selection. For example, the apparatus could employ indirect drive for gearing the motor, as through a belt and pulley or other kinematic arrangement.

Figure 4:
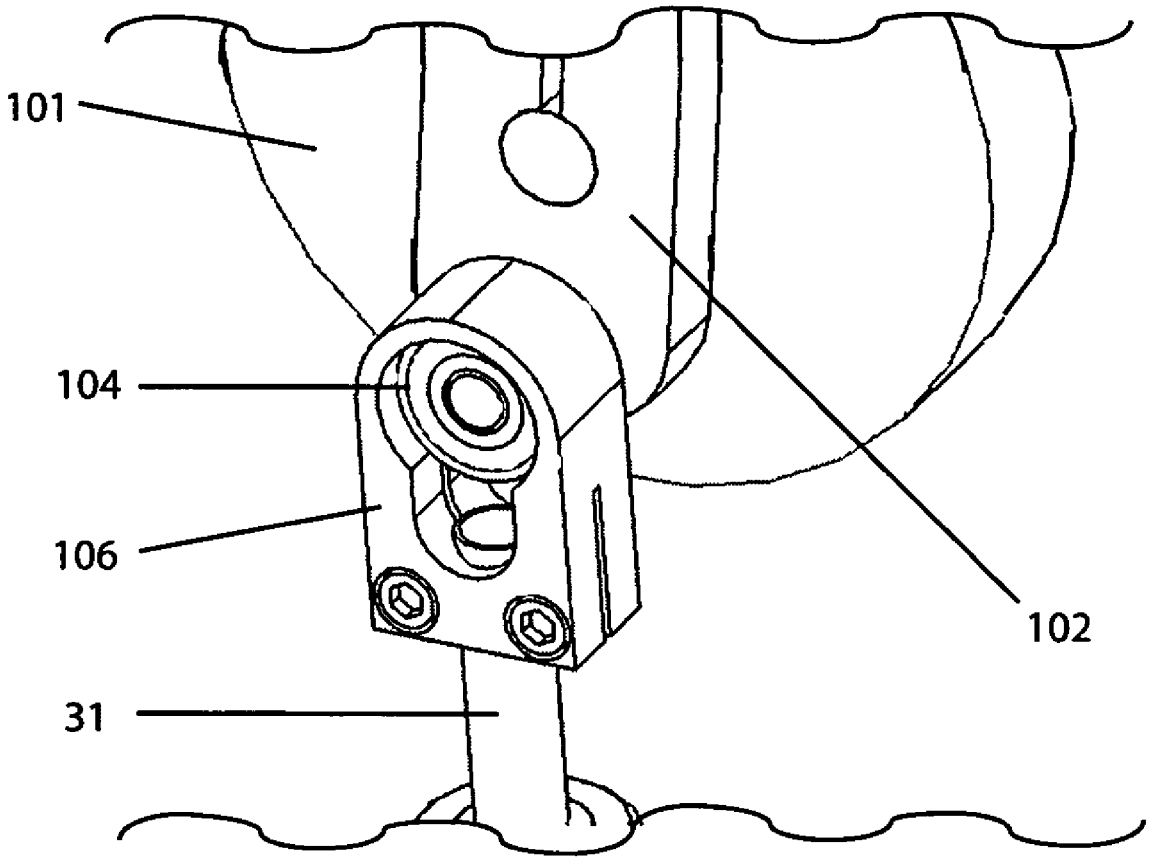
FIG. 4 is an enlarged partial perspective view thereof.

Once again, FIG. 4 is an enlarged partial view of the compressor unit 30 of the combination apparatus 20 showing the details of the piston rod 31 attached at its free upper end to the motor 101 on an offset arm 102 having a bearing 104 or the like press fit within the intake block 106.

Figure 5:
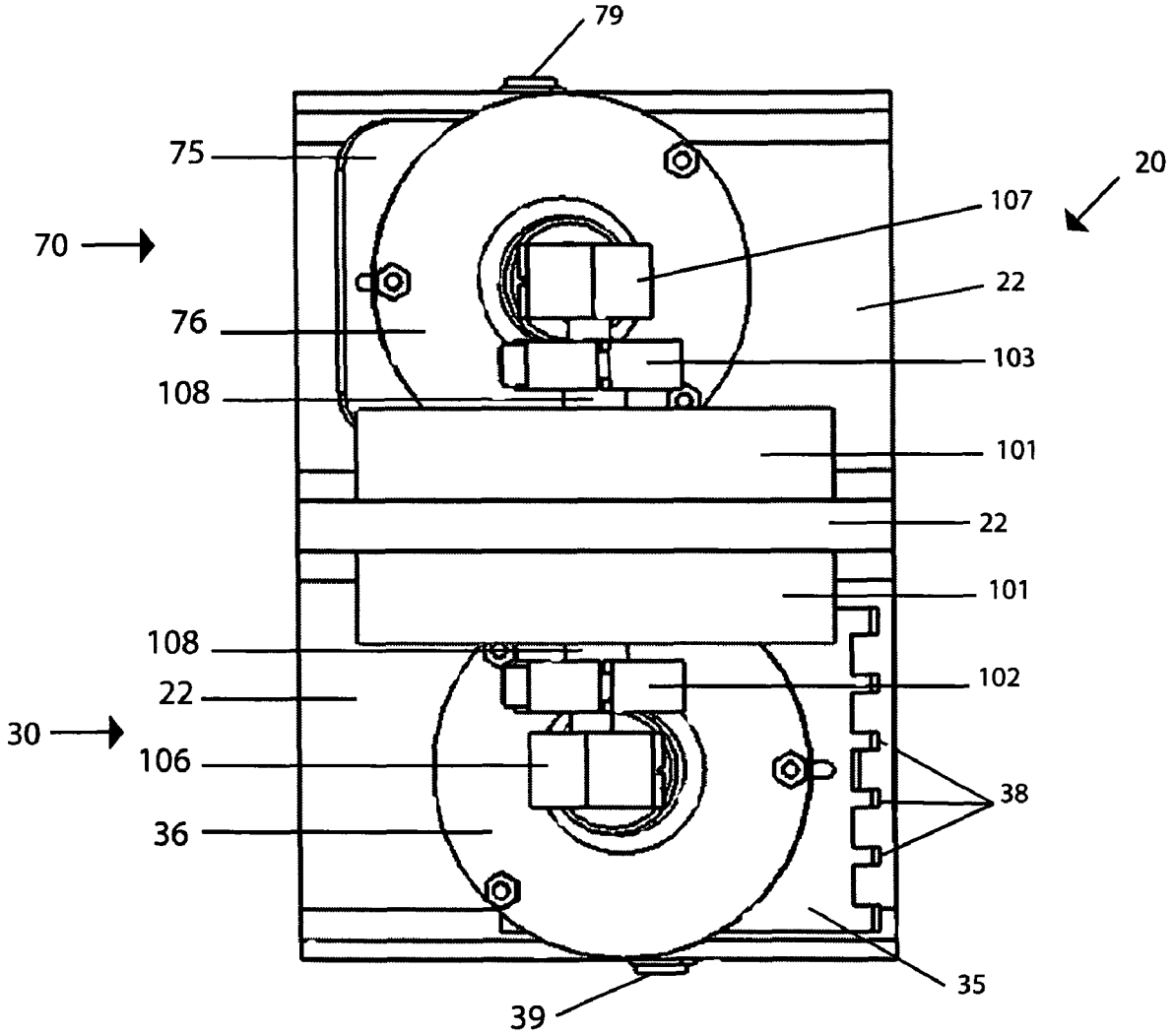
FIG. 5 is a top view thereof.

Turning to FIG. 5, there is shown a top view of the of the combination compressor and vacuum pump apparatus 20 of the present invention showing the compressor unit 30 and the vacuum pump unit 70 in their side-by-side configuration. As best seen in this view, the units are each operably connected to the motor 101 via their respective offset arms 102, 103 mounted on a common drive shaft 108 of the motor 101. As then shown in FIGS. 6 and 7, in the exemplary embodiment, the arms 102, 103 are mounted on the drive shaft 108 so as to be radially offset with respect to each other such that the vacuum pump 70 lags the compressor 30 by approximately 30°. As will be appreciated, the offset is achieved not only by the angular positions of the respective arms 102, 103 but also by the off-line orientation of the respective pivot pins 39, 79.

Figure 6:
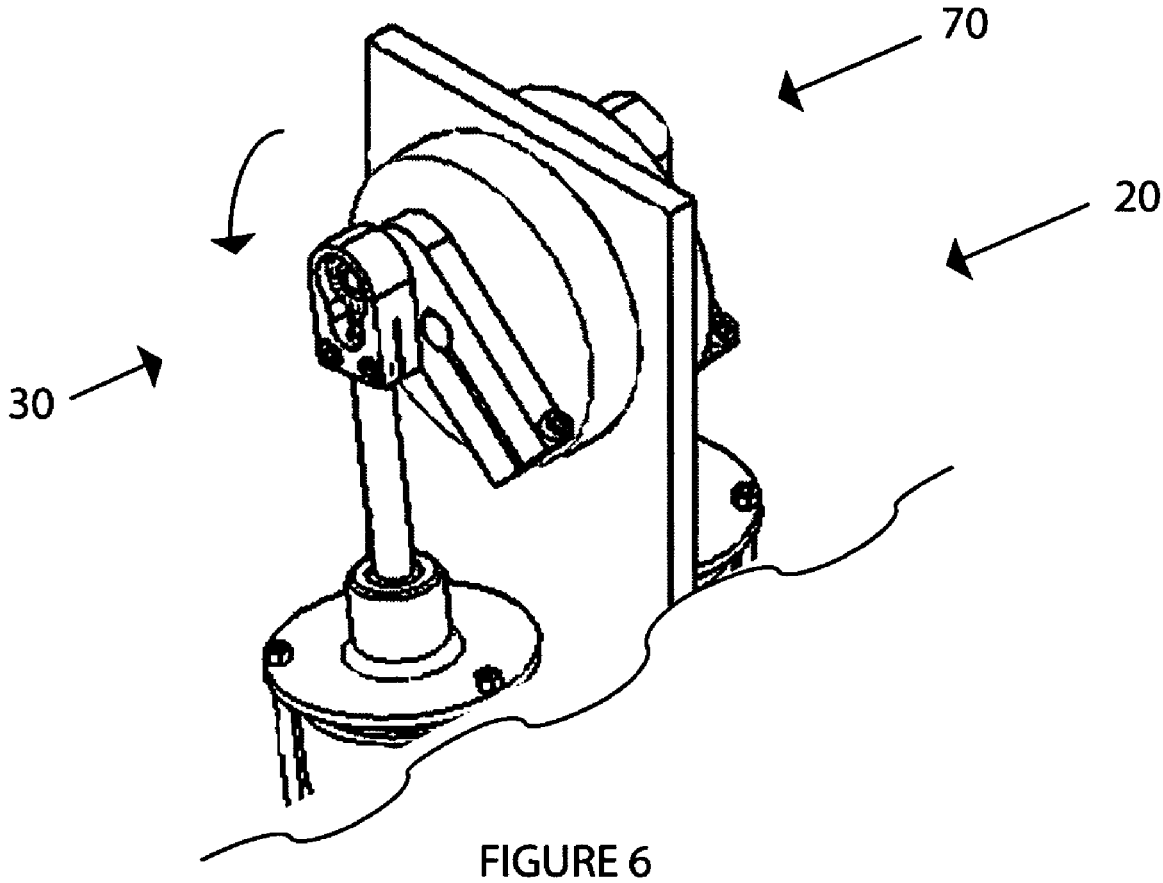
FIG. 6 is an enlarged partial perspective schematic view thereof.
Figure 7:
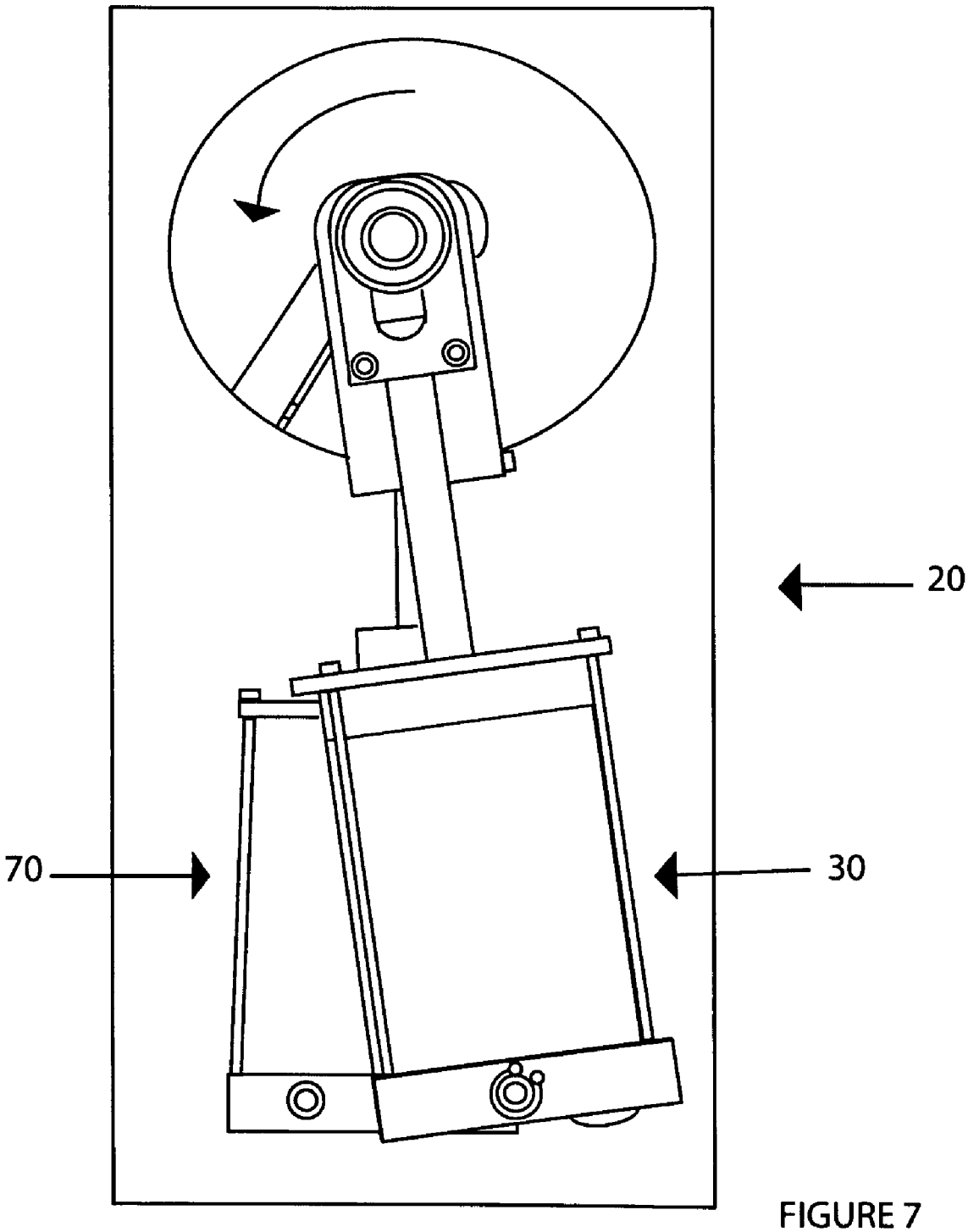
FIG. 7 is a left side schematic view thereof in a first phase of operation.
Figure 8:
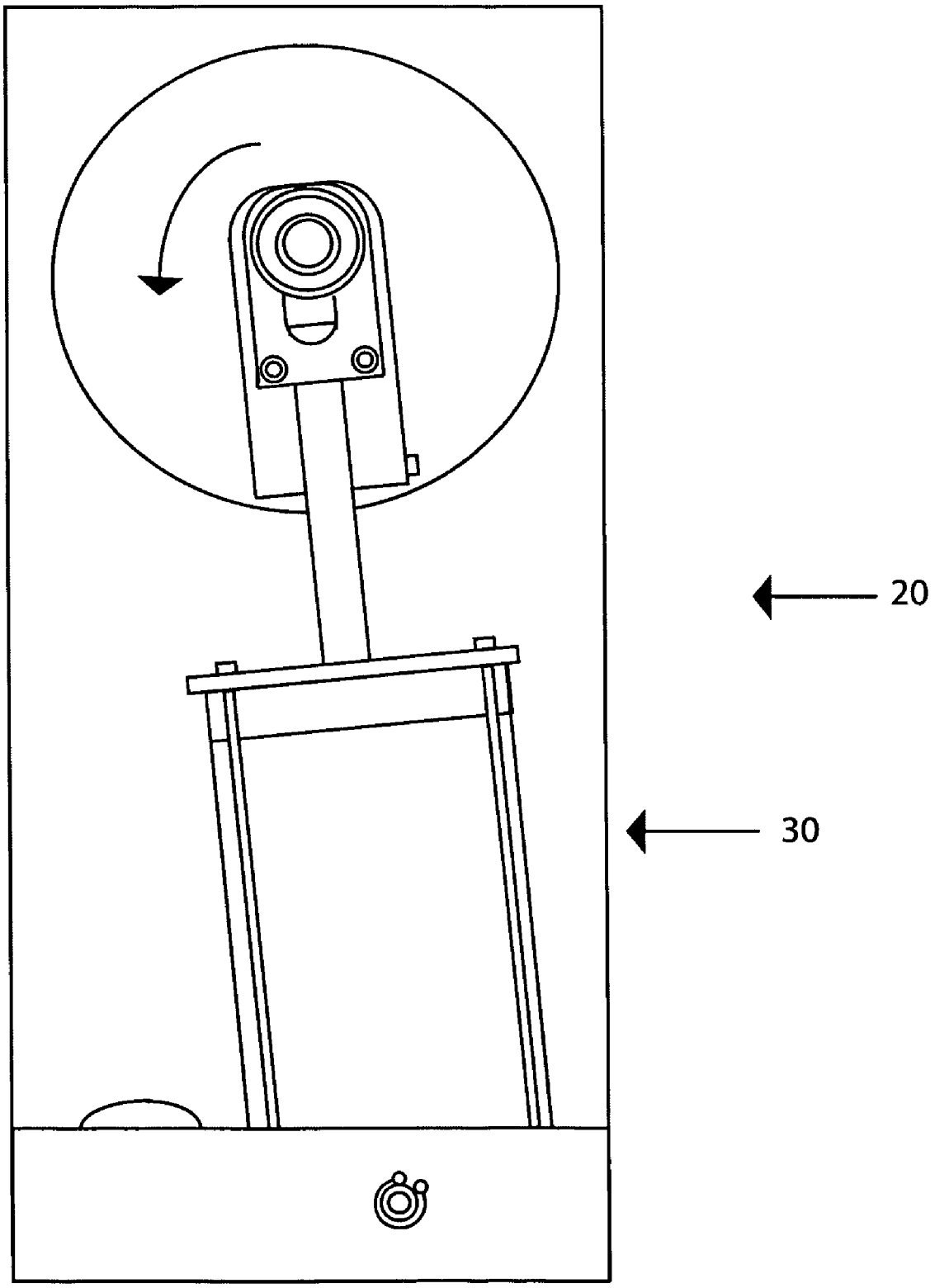
FIG. 8 is a left side view thereof in the first phase of operation.
Figure 9:
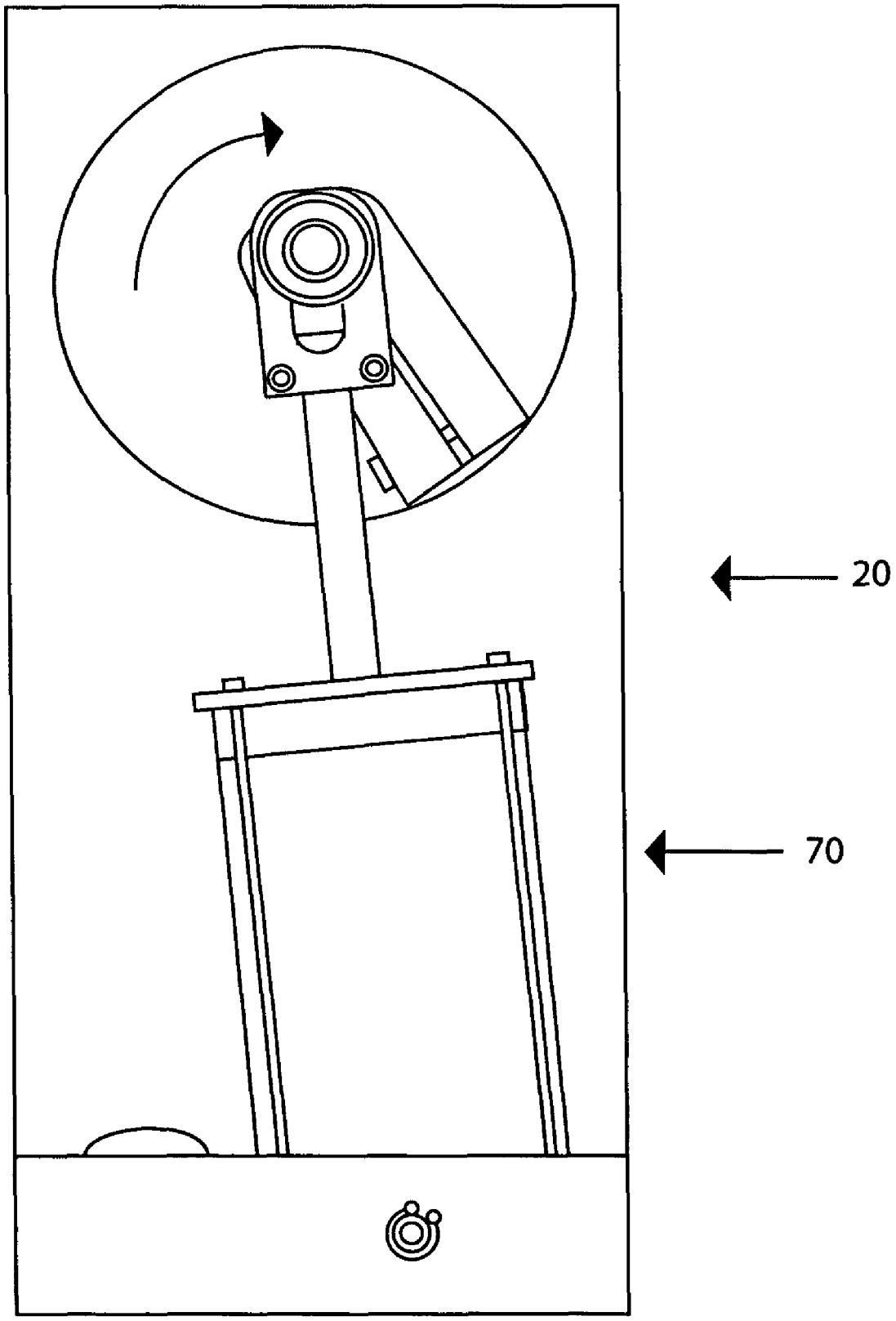
FIG. 9 is a right side view thereof in the first phase of operation.

It will be appreciated by those skilled in the art that the offset of the compressor and vacuum pump units 30, 70 is merely exemplary and can vary depending on the relative sizes and configurations of the cylinders, the performance requirements for the overall apparatus and other such factors. Specifically, the compressor unit 30 and vacuum pump unit 70 may be 100% in phase (0° out of phase), may be 180° out of phase, or anything in between. In FIGS. 6 and 7, arrows are shown to indicate the direction of rotation of the motor 101, which in the exemplary embodiment is counter-clockwise as looking at the compressor 30, or the left side of the apparatus 20, and clockwise as looking at the vacuum pump 70, or the right side of the apparatus 20, whereby, again, the vacuum pump 70 follows the compressor 30 through the cycle. For example, when the compressor is roughly at its top-dead-center position as shown in FIG. 6, the vacuum pump requires roughly 30° further clockwise rotation of the drive for its cylinder 73 to reach its top-dead-center position, and so on. The same can be seen with reference to the respective left and right side views in FIGS. 8 and 9 of the combination compressor and vacuum pump apparatus 20 at the same phase position as shown in FIGS. 6 and 7.

Figure 10:
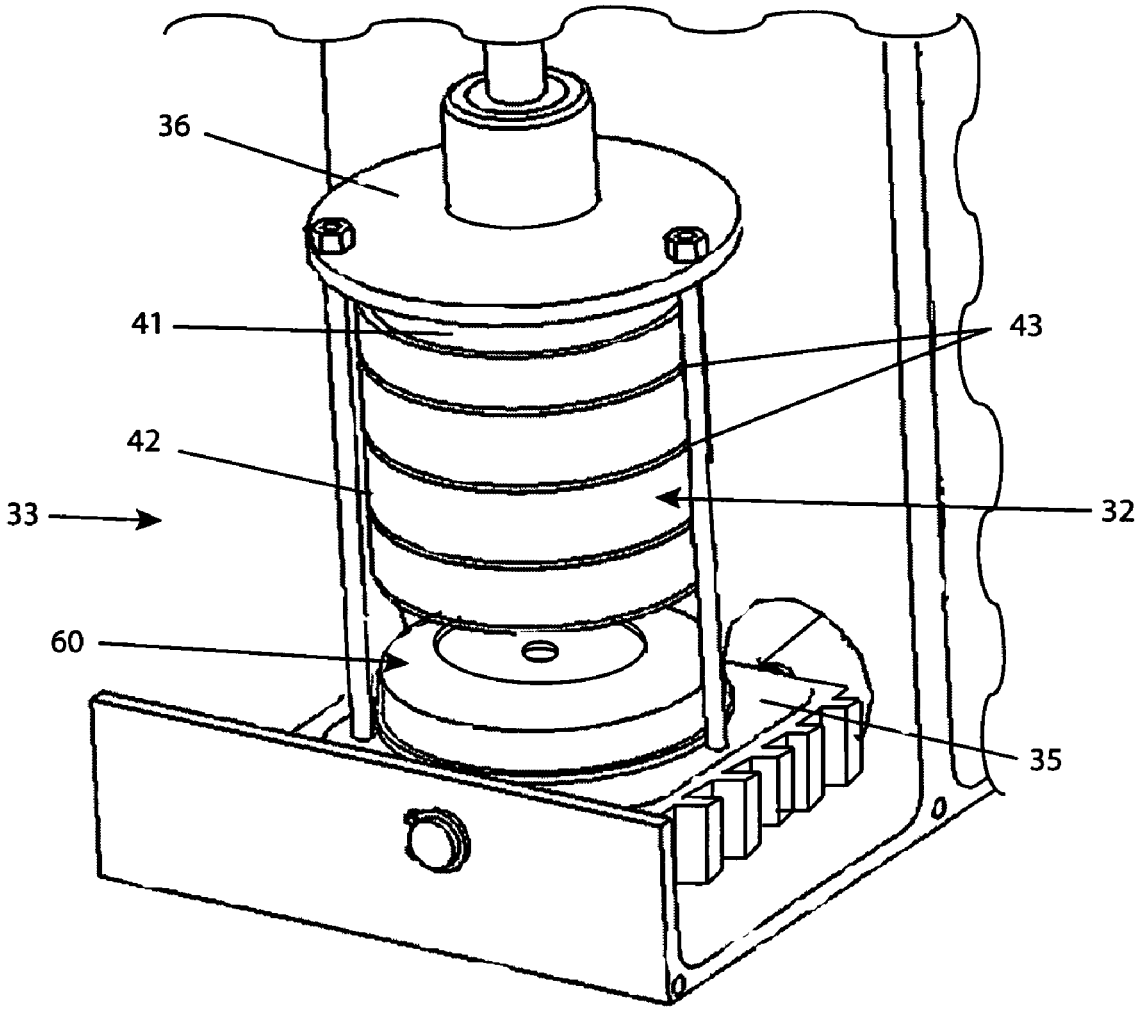
FIG. 10 is an enlarged partial left perspective view thereof, partially cut-away.

Referring now to FIG. 10 there is shown an enlarged partial perspective view of the cylinder 33 of the compressor unit 30 with the cylinder body 34 removed for ease of viewing the interior piston 32. The piston 32 is configured as an "air gap" piston having an annular piston body 42 formed with circumferential, spaced-apart grooves 43 thereabout rather than separate piston rings or o-rings. In the exemplary embodiment, the piston 32 is on the order of 2" in length with three to four grooves 43 spaced approximately ¼" to ½" apart along the piston body 42, though any number of grooves is possible depending on the application. The piston body 42 itself may be constructed of a material such as graphite or aluminum alloy with little to no coefficient of expansion. In such an "air gap" piston arrangement, the clearance between the outside wall of the piston body 42 and the inside wall of the cylinder (not shown) is approximately 0.0005"±0.0005", again, depending on the application, and particularly, the pressure, positive or negative, that the piston will see. For the compressor unit 30, specifically, it will be appreciated that because most of the work is being done as the piston 32 approaches its bottom-dead-center position, or the end of its down stroke, wherein virtually the entire length of the piston body 42 will be called upon to effectuate a surface-to-surface seal with the inside wall of the cylinder body 34, it is not so when the piston 32 is doing the relatively easy work of gathering air on its upstroke. As such, while the above clearance of approximately 0.0005"±0.0005" is preferable for at least that portion of the stroke near to bottom of the down stroke, or the phase of operation of maximum compression, at the upper end of the cylinder, or nearer to the end of the piston's upstroke, a greater clearance between the piston body 42 and either the inside surface of the cylinder wall or the inside surface of the upper cap 36 may be employed without compromising the operation or performance of the compressor unit 30 and actually furthering the life of the unit by reducing the work and wear of the moving parts where not necessary. This increased clearance at the top end of the compressor cylinder 33 may be achieved in a number of ways, including but not limited to an enlarged or stepped bore within the cylinder body 34 at its upper end or a relatively constant diameter cylinder body 34 having a relatively shorter overall length, with the additional distance or total length of the cylinder 33 being taken up by a relatively longer downwardly extending skirt 41 on the upper cap 36, which skirt 41 could thus have an inside diameter that is slightly larger than that of the cylinder body 34. In the exemplary embodiment of the compressor unit 30, the nominal stroke for the piston 32 is 1" and the nominal diameter of the cylinder body 34 is 2". Even so, because the cylinder body 34 is constructed of cast iron, chromolly steel or aluminum alloy and the cap 35 is constructed of relatively lighter weight Delrin or certain other aluminum or magnesium alloys, increasing the size of the cap 35 relative to the cylinder body 34 may potentially reduce the weight at the upper end of the cylinder 33 and thus minimize vibration. Those skilled in the art will once more appreciate that a virtually infinite number of cylinder stroke lengths and diameters may be specified within a combination compressor and vacuum pump apparatus according to the present invention without departing from its spirit and scope. With continued reference to FIG. 10, at the lower end of the compressor cylinder 33 mounted on or integral with the base 35 is an annular exit valve assembly 60 that selectively allows for the escape or exit of compressed air from the lower chamber of the compressor cylinder 33 during use, more about which is said below in connection with FIGS. 14 and 15. O-rings may be employed to effectuate air-tight seals between any mating surfaces, such as between the exit valve assembly 60 and the lower end of the compressor cylinder body 34, such o-rings being typically formed of a urethane or EPDM (ethylene propylene) material. The bottom valve assembly 60 and cylinder base 35 may be formed of an aluminum or magnesium for improved heat dissipation, with or without the cooling fins 38. Briefly, in FIG. 11 there is shown a similar view to that of FIG. 10, now with the piston body 42 also removed to better view the piston base 44 including an upwardly extending collar 45 for stabilizing the piston 32 on the piston rod 31 and further including one or more through-holes 46 for selectively communicating between the hollow space within the piston 32 above the piston base 44 and bounded by the piston body 34, or effectively the upper chamber of the cylinder 30, and the opposite lower chamber in which the compression takes place.

Figure 12:
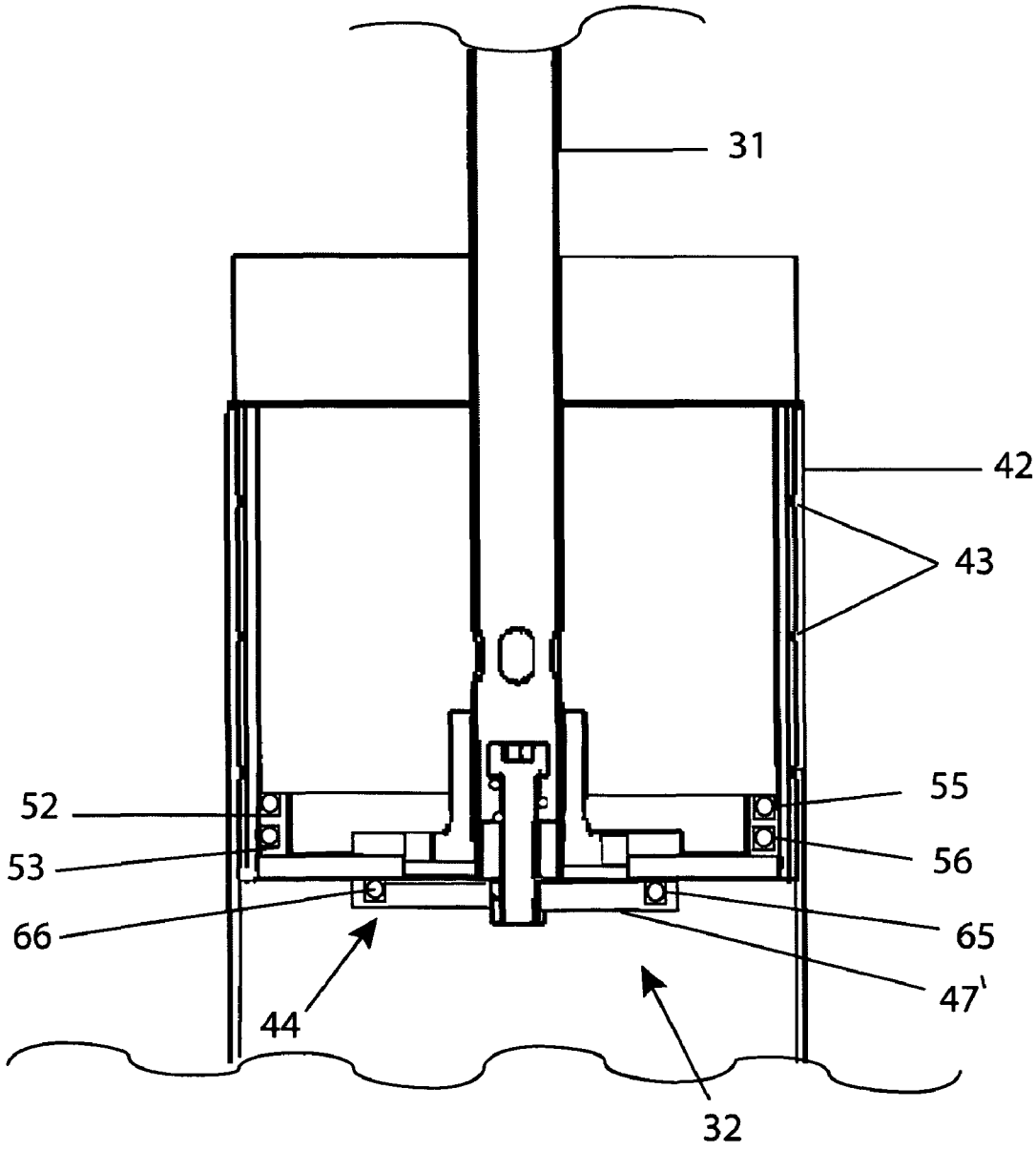
FIG. 12 is an enlarged partial schematic view of an exemplary cylinder thereof.
Figure 13:
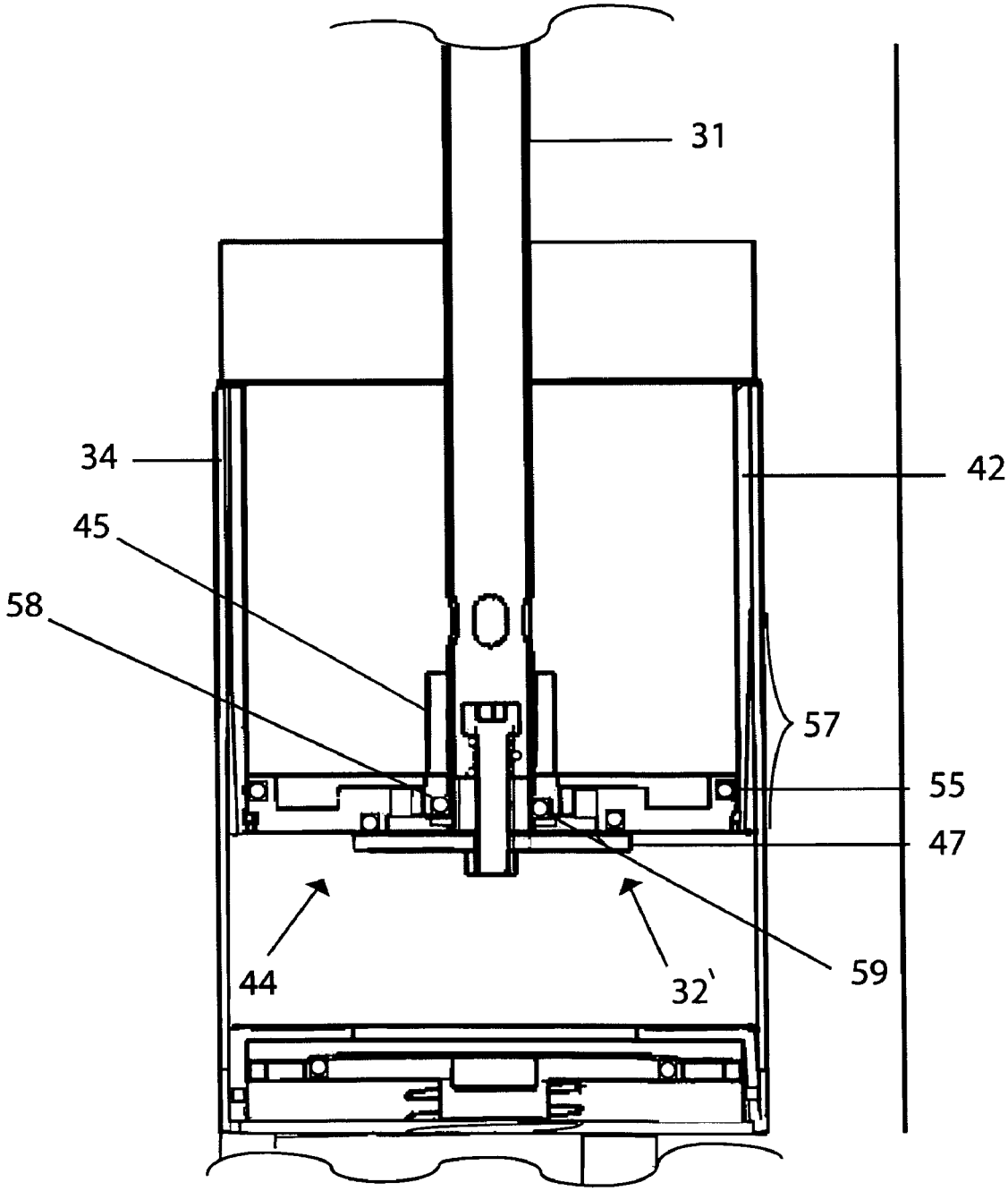
FIG. 13 is an enlarged partial schematic view of an alternative exemplary cylinder thereof.

Referring now to FIGS. 12 and 13, there are shown two enlarged partial schematic views of exemplary piston-cylinder arrangements according to further aspects of the present invention. While a compression configuration and a hollow piston rod 31 typically employed in a first stage or single-stage set-up as for the compressor unit 30 in FIG. 1 is shown, the "internal breathing" piston 32 with various valve arrangements may be employed within any compression or vacuum stage, whether pulling ambient air in through the hollow piston rod, receiving pre-charged air from a preceding compression or vacuum stage through a valve in the cylinder's cap, or pushing air out through the hollow piston rod. First, in FIG. 12, there is shown a relatively long piston skirt 42 installed on the piston base sub-assembly 44 to form the piston assembly 32. Specifically, two offset, substantially parallel o-rings 55, 56 seated within channels 52, 53 in the outer wall of the piston base 44 are employed to secure the piston body 42 on the base 44 in a "rooted" or "resilient mounting" fashion to further prevent any side-load during operation of the piston within the cylinder and thereby encourage centering and even wear. It is contemplated that the upper o-ring 55 would position for radial loading, while the lower o-ring 56 would position for axial loading, though it will be appreciated that this is not necessary and that the sizes and materials of the o-rings and the sizes and shapes of the corresponding channels will dictate, at least in part, the function of each o-ring. It will be further appreciated that while two o-rings are shown and described, other numbers of o-rings may be employed without departing from the spirit and scope of the present invention. In the exemplary embodiment, the piston 32 is again configured as an "air gap" piston wherein the annular piston body 42 is formed with circumferential, spaced-apart grooves 43 therealong rather than separate piston rings or o-rings, though it will be appreciated that any combination of such sealing means may be employed depending on the application, even including a relatively shorter skirt or shorter length piston body not having grooves, but instead perhaps having a relatively thicker wall.

Turning to FIG. 13, there is shown an alternative embodiment of the piston skirt 42' of the piston 32' wherein at least a portion 57 of the skirt 42' is tapered. By tapering the skirt 42' from its upper end or some intermediate point along the skirt 42', as shown, to the skirt's lower end, or the working end of the piston, less wall-to-wall contact between the skirt 42' and the inside surface of the cylinder body 34 is achieved when less sealing is needed, as in the air-gathering and initial compression portions of the stroke. It will be appreciated that then as the pressure builds in the lower chamber when the piston 32' is on its down stroke there will be a slight outward pressure on the base of the piston skirt 42' as exerted by the additional force on the piston base 44', which force translates to at least radial force on the at least one o-ring 55, thereby forcing the skirt slightly outwardly and bringing even the tapered portion 57 of the skirt into more substantial contact with the cylinder 34. Depending on the application, and thus the pressure and forces to be seen by the piston and the materials and construction of the piston components, and hence the flex and expansion properties of these components, it will be appreciated that the taper on the outer wall of the piston skirt 42' may be optimized to achieve the necessary sealing as the pressure builds while minimizing, or not unnecessarily incurring, surface contact or forces between the piston and cylinder. It will be further appreciated that such tapers, while potentially of any configuration and angle, will in most applications likely be on the order of five thousandths of an inch (0.005") or less and, as such, that the taper shown in FIG. 13 is exaggerated merely for illustration. As shown in FIGS. 12 and 13, the exemplary floating disk valve 47, 47' may be solid with the sealing o-ring seated opposite the disk valve 47 within the piston base 44 (FIGS. 13-15), or in an alternative embodiment the o-ring 66 may be seated within a corresponding groove 65 or channel formed in the surface of the disk valve 47' itself (FIG. 12). These and other configurations of the valve are possible without departing from the spirit and scope of the invention.

Regarding the materials of construction, the piston body 42 itself may be made of a material such as graphite or aluminum alloy with little to no coefficient of expansion. The cylinder body 34 may be generally constructed of cast iron, chromolly or stainless steel, or aluminum alloy. The wall of the cylinder 34 may be a solid, continuous material formed from any appropriate process now known or later developed. Alternatively, a separate sleeve or liner (not shown) may be press-fit within the inside diameter of the cylinder 34 or the inside surface of the cylinder 34 may otherwise be coated with a material other than that of the cylinder 34 itself for improved friction and wear performance. For example, a cast iron sleeve (not shown) may be inserted within an aluminum cylinder body 34. An aluminum cylinder 34 may also be hard anodized to again improve friction and wear. Once again, it will be appreciated by those skilled in the art that the described materials are merely exemplary and that any other materials now known or later developed as having properties suitable for any compression or vacuum pump apparatus application contemplated herein may be used without departing from the spirit and scope of the invention.

Figure 14:
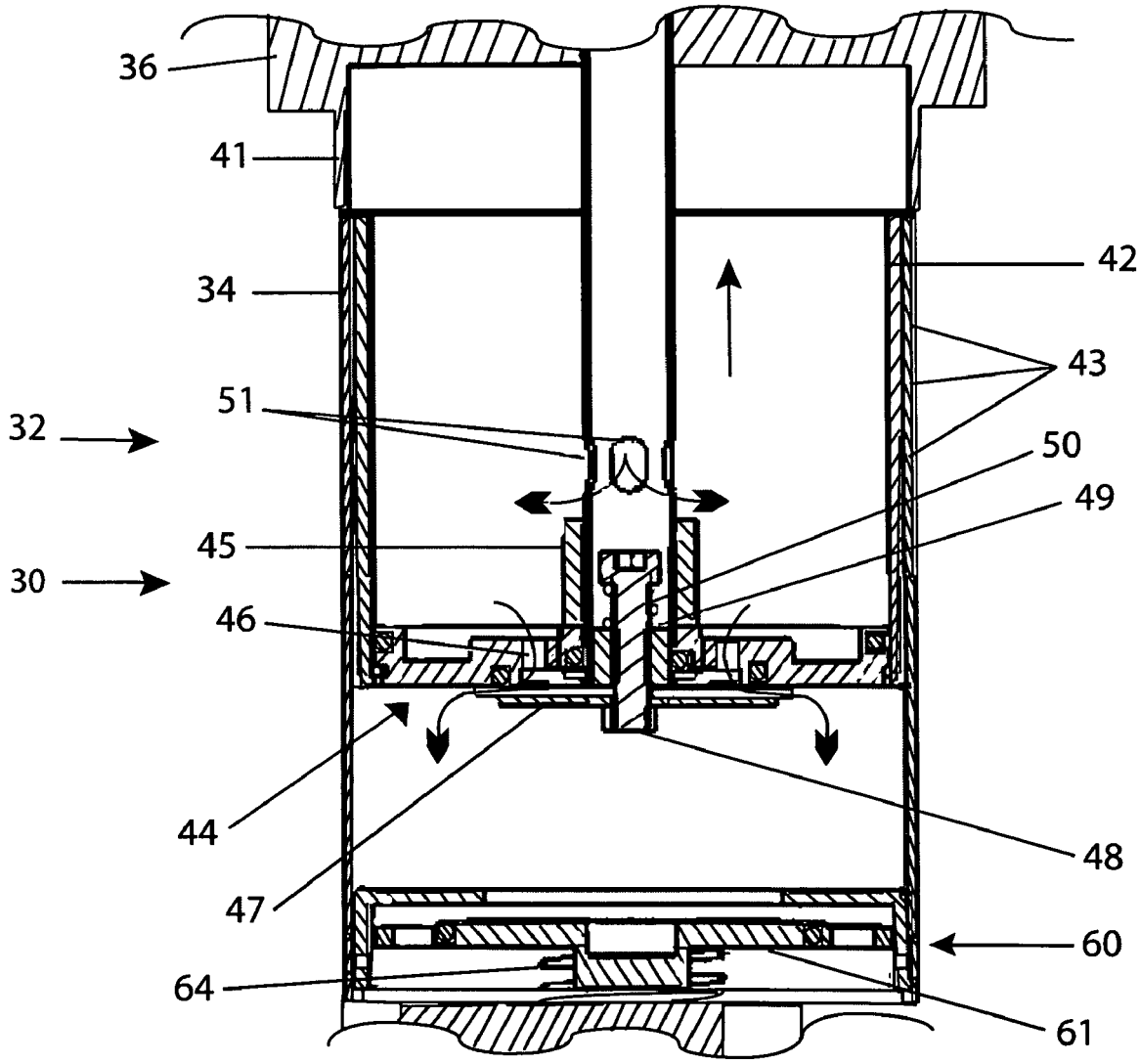
FIG. 14 is an enlarged partial cross-sectional view of a further alternative exemplary cylinder thereof on its upstroke.
Figure 15:
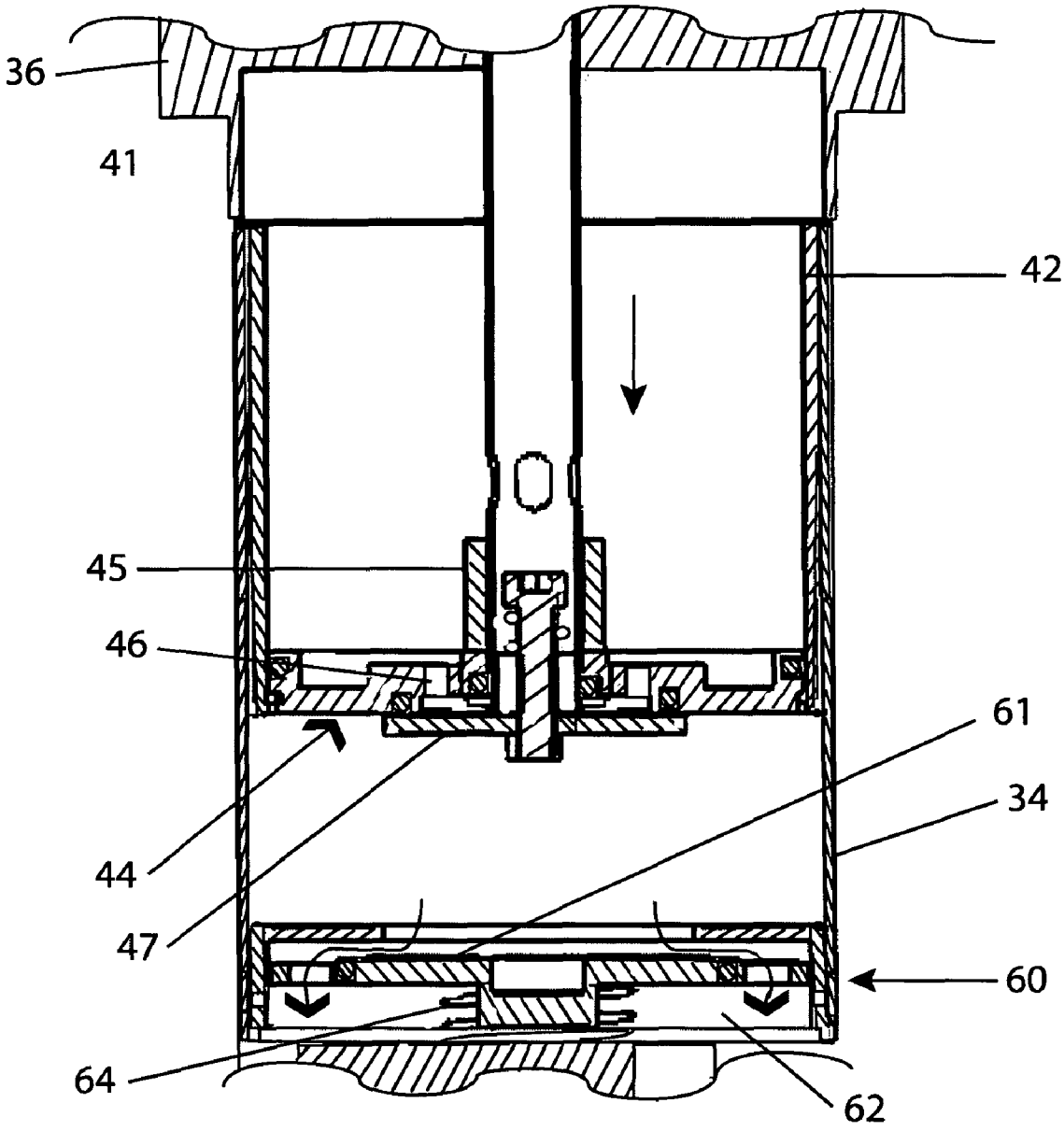
FIG. 15 is a partial cross-sectional view of the alternative exemplary cylinder thereof shown in FIG. 14 now on its down stroke.
Figure 16:
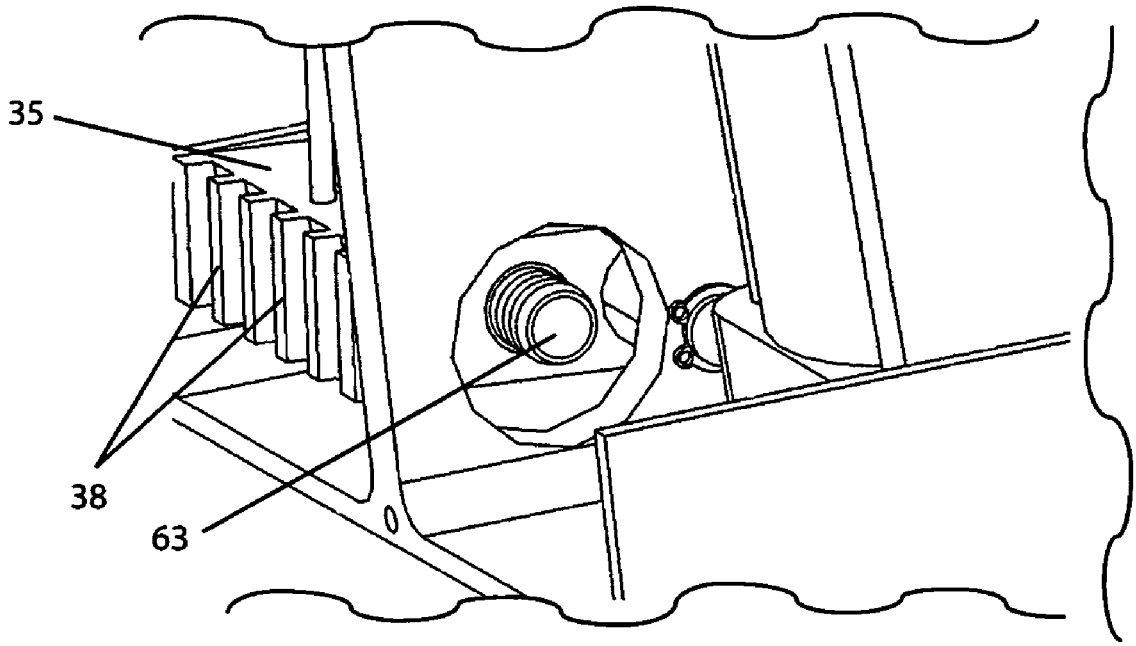
FIG. 16 is an enlarged partial right perspective view thereof.

Turning now to FIG. 14, there is shown a cross-sectional view of the compressor cylinder 30 wherein the piston 32 is on its up stroke. In this phase of the stroke, the piston valve 47 is pulled open by the initial vacuum in the lower chamber as the piston starts up, and to a lesser degree also by inertial and/or gravitational effects on the valve 47. The valve 47 opens against a biasing spring 50 positioned between the upper end of a mounting bolt or pin 48 passed through a plug 49 in the lower end of the piston rod 31. It will be appreciated that this and other such biasing springs employed in the present invention to selectively close various piston and inlet or exit valves also address valve float issues, which may be more or less prevalent depending on the speed of the motor and whether direct drive is employed, and hence depending on the dynamic movement of the piston itself, and the operation of the apparatus in orientations other than upright, such that gravitational effects not only are not to be relied upon for the successful operation of the valves, but are addressed when they actually would tend to work against proper valve operation. As such, air passing down the hollow bore of the piston rod 31 exits one or more cross-holes 51 formed in the rod 31 above the collar 45 and, after being pre-compressed in the upper chamber as the piston moves upward, passes through the one or more through-holes 46 formed in the piston base 44 and around the open piston valve 47 into the lower chamber, which is closed at the bottom by the exit valve 61, biased so by a spring 64. Then, as shown in FIG. 15, when the piston 32 starts on its down stroke the piston valve 47 closes through the cooperation of the biasing spring 50, the increasing pressure in the lower chamber, and to some extent inertial effects. As such, whatever air is in the lower chamber when the piston 32 begins its down stroke with the valve 47 now closed is then compressed. Eventually, the pressure in the lower chamber is then sufficient to open the lower exit valve 61 of the exit valve assembly 60 against the exit valve biasing spring 64 so that the compressed air can exit the cylinder by passing around the lower valve 61 and into the absorption or reaction chamber 62 and eventually out through the exit port 63 (FIG. 16). Those skilled in the art will appreciate that the reaction chamber 62, and its relatively larger volume as compared to the clearance pocket, enables improved discharge of the compressed air with relatively lower pressure differentials between that of the cylinder and that of the system. FIG. 16 is a close-up perspective view of the outlet port 63.

Figure 11:
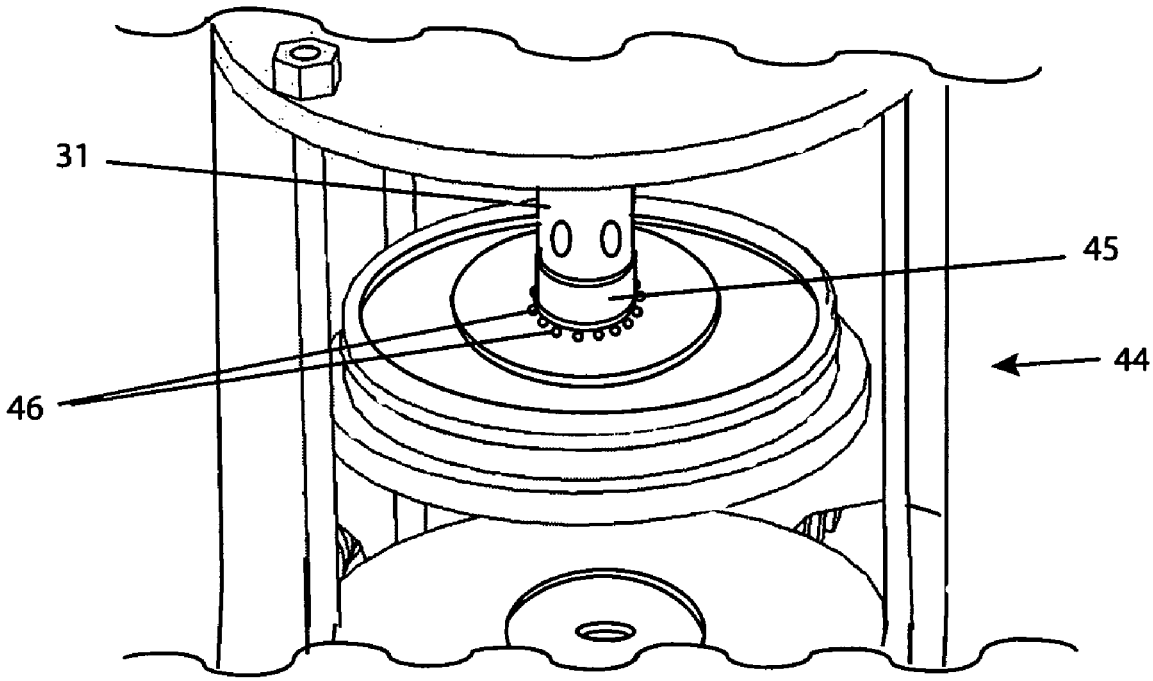
FIG. 11 is an enlarged partial left perspective view thereof, further partially cut-away.
Figure 17:
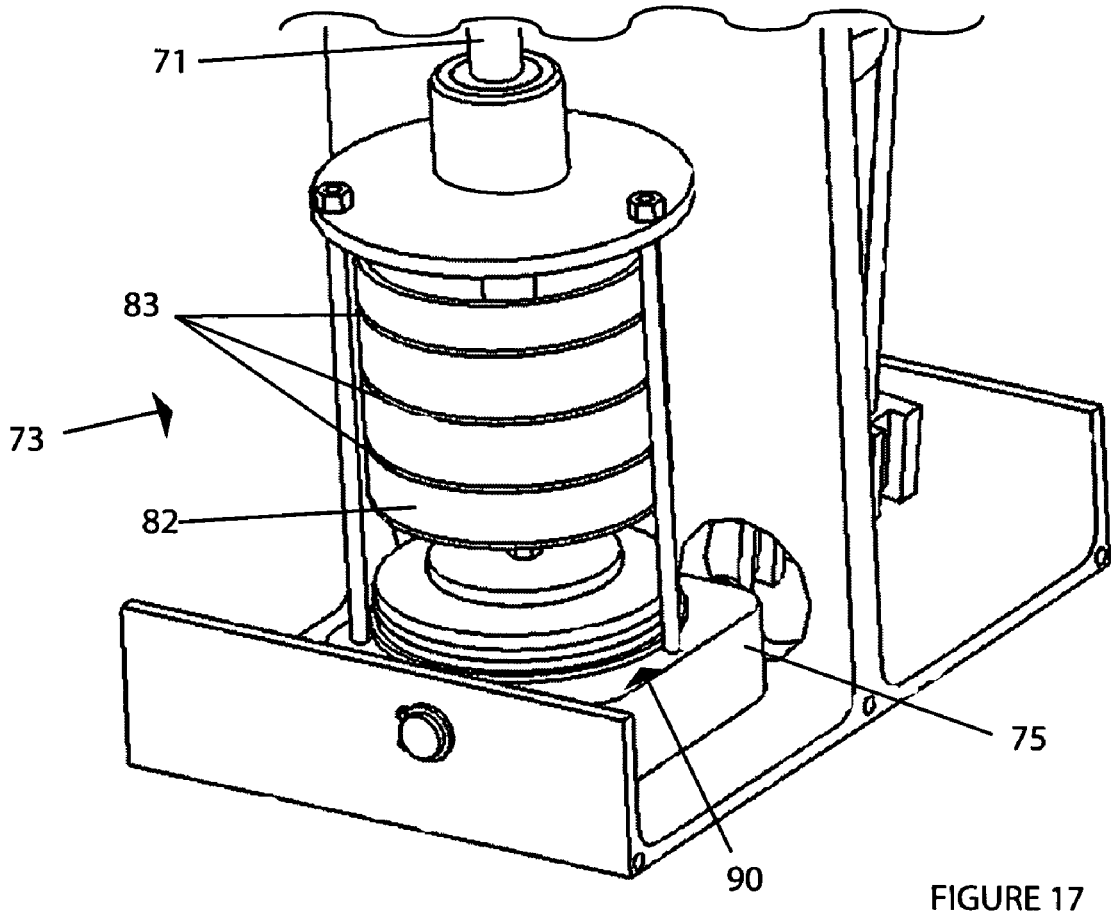
FIG. 17 is an enlarged partial right perspective view thereof, partially cut-away.
Figure 18:
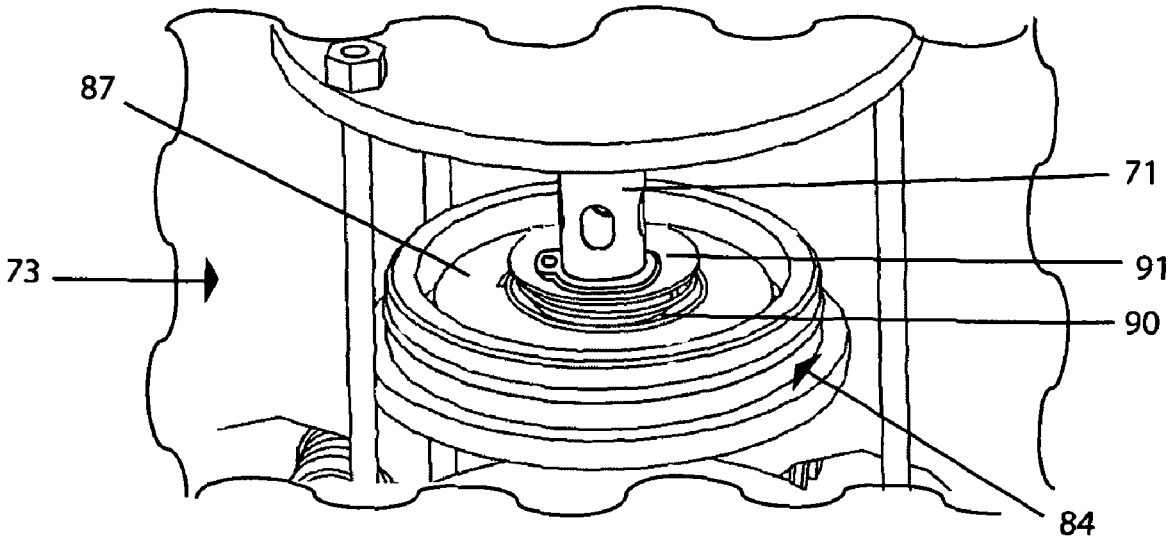
FIG. 18 is an enlarged partial right perspective view thereof, further partially cut-away.
Figure 19:
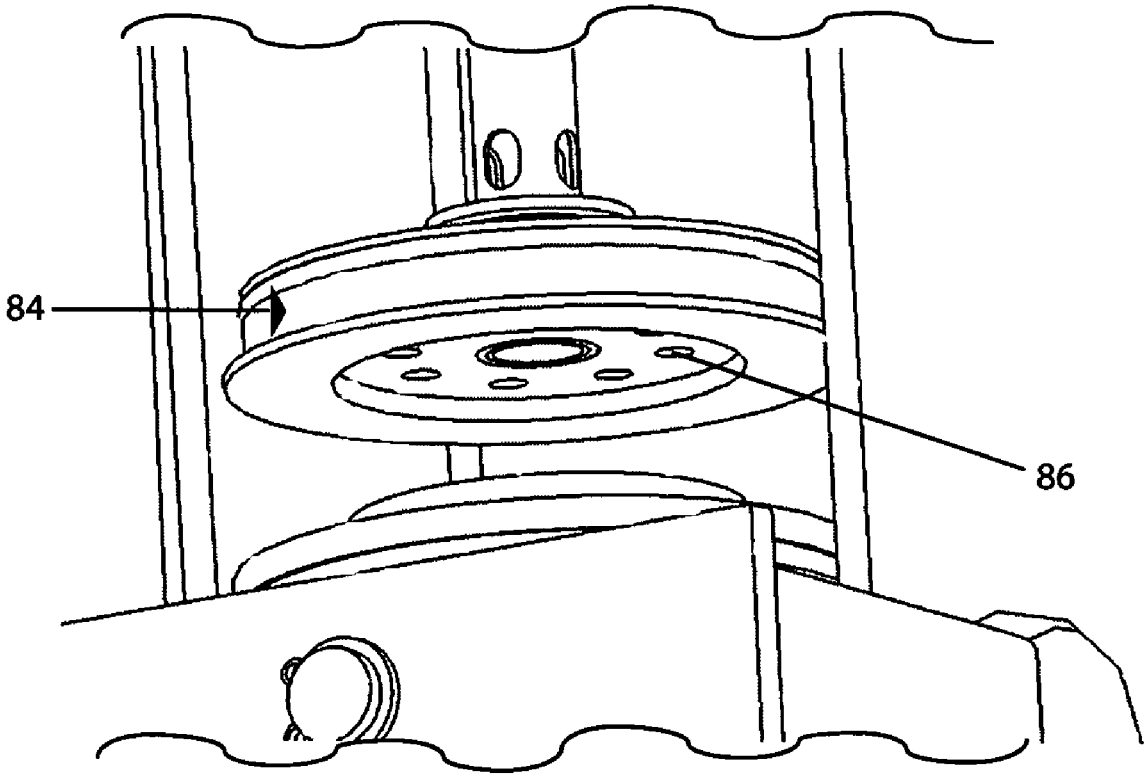
FIG. 19 is an enlarged partial right perspective view as partially cut-away as shown in FIG. 18, as now viewed substantially from below.
Figure 20:
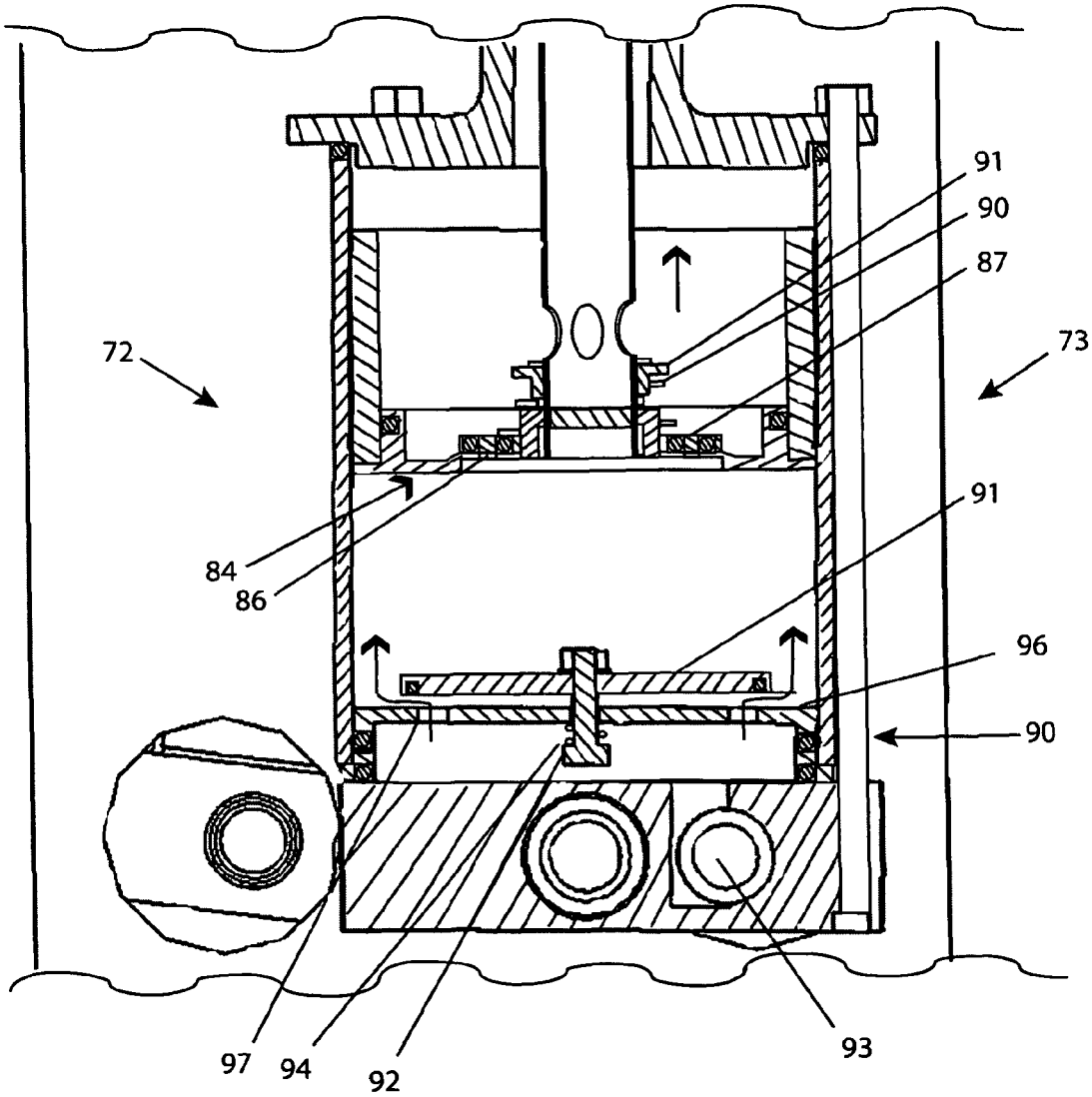
FIG. 20 is an enlarged partial cross-sectional view of a further alternative exemplary cylinder thereof on its upstroke.
Figure 21:
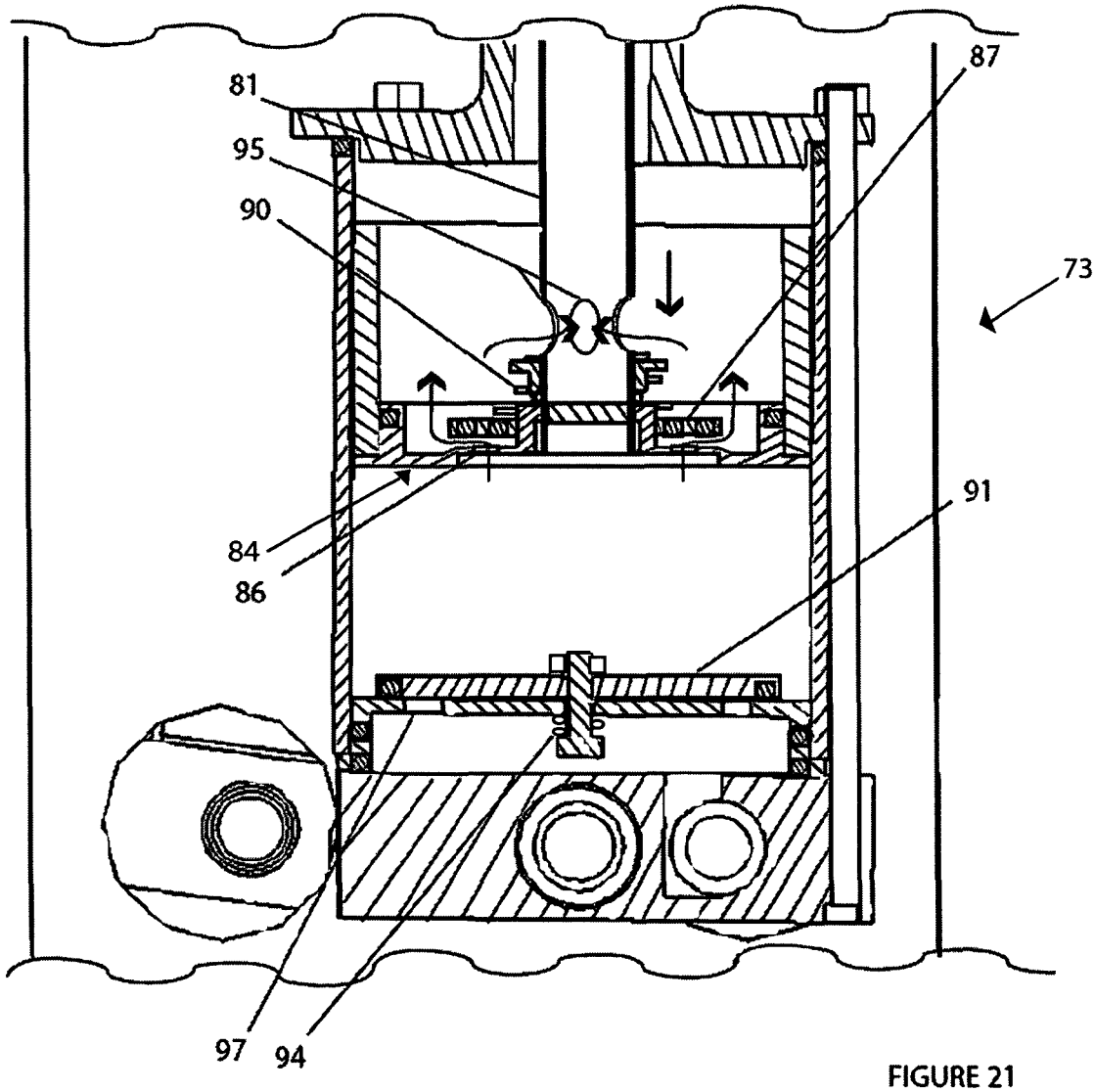
FIG. 21 is a partial cross-sectional view of the alternative exemplary cylinder thereof shown in FIG. 20 now on its down stroke.

Referring now to FIGS. 17-19, there are shown enlarged, partial perspective views of the vacuum pump cylinder 70 analogous to those view of FIGS. 10 and 11 for the compressor unit 30. First, in FIG. 17, the vacuum piston 72 is again shown with the cylinder body 74 removed and as having an annular piston body 82 therein formed with circumferential, spaced-apart grooves 83 therealong. At the lower end of the vacuum pump cylinder 73 mounted on or integral with the base 75 is an annular inlet valve assembly 90 that selectively allows for the passage of air into the lower chamber on the piston's upstroke so as to effectively pull a vacuum, which air is then evacuated through the piston rod 71 on the piston's down stroke, as explained below in connection with FIGS. 20 and 21. The base 75 and/or inlet valve assembly 90 may be glass-filled nylon, Delrin, aluminum or magnesium, though, again, it will be appreciated that any material now known or later developed may be employed without departing from the spirit and scope of the invention. In FIG. 18 there is shown a further enlarged perspective view of the vacuum pump cylinder 73 now with the cylinder body 74 also removed to reveal the piston valve 87 now formed on upper side of the piston base 84. The valve 87 is biased closed against the piston base 84 so as to selectively seal the through-holes 86 formed therein, as best seen in FIG. 19. A spring 90 secured about the piston rod 71 relative to the valve 87 by a keeper washer 91 or the like provides the biasing force in the exemplary embodiment, though it will be appreciated by those skilled in the art that a variety of mechanical arrangements for achieving the necessary selective opening and closing of the vacuum piston valve 87, or any other such valve incorporated in the present invention, are possible without departing from the spirit and scope of the invention. Once again, the lower end of the piston rod 71 is plugged by a plug 89, as best seen in FIGS. 20 and 21. In the exemplary vacuum pump unit 70, the cylinder again has a roughly 2" nominal diameter with a nominal stroke length of 1¼".

During operation of the vacuum pump cylinder 70, then, as shown in FIGS. 20 and 21, first, when the piston 72 is on its upstroke as in FIG. 20, the lower inlet valve 91 of the inlet valve assembly 90 is opened by the vacuum force against the resistance of the biasing spring 94 held in place by and operating against a bolt 92 that is integral with the valve disk 91 and passes through the upper wall 96 of the inlet valve assembly 90. With the lower inlet valve 91 so opened, air can be pulled into the lower chamber from the inlet port 93 by passing through the hollow interior of the inlet valve assembly 90 and through-holes 97 formed in the assembly's upper wall 96 and then around the raised inlet valve 91 and into the lower chamber of the vacuum pump cylinder 73. It will be appreciated that the vacuum in the lower chamber is possible because the selectively openable piston valve 87 is closed against the upper surface of the piston base 84, again, as by primarily the biasing spring 90, though in part also by inertial effects and gravitational effects. Finally, referring to FIG. 21, the vacuum pump piston 72 is now on its down stroke, which amounts to the exhaust stroke for the vacuum pump unit 70. As the piston 72 starts on its way down, the decreasing vacuum in the lower chamber in cooperation with the biasing spring 94, at equilibrium serves to now close the lower inlet valve 91. The corresponding or resulting decrease in pressure turning into vacuum within the upper chamber itself as the piston 72 moves downwardly then forces the piston valve 87 open against its respective biasing spring 90. This allows the air in the lower chamber drawn in on the preceding upstroke to pass through through-holes 86 formed in the piston base 84 and around the piston valve 87 into the upper chamber. Then, when the piston starts back on its upstroke and the piston valve 87 again closes, it will be appreciated that air in the upper chamber would then simply flow through the cross-holes 95 formed in the piston rod 81 and then up the hollow bore of the piston rod and out of the system through the block 107 (FIG. 3). As such, those skilled in the art will thus appreciate that while on the compressor side, air is drawn in through the piston rod, compressed in the lower chamber and pushed out through the lower valve all in cooperation with a selectively openable piston valve, on the vacuum pump side, air is instead drawn in through the lower valve as a vacuum is pulled in the lower chamber and then evacuated through the piston rod after passing through the selectively openable piston valve and entering the upper chamber. It will be further appreciated that the opposite arrangement for both compression and vacuum could just as easily be achieved by doing the work in the upper chamber above the piston. Accordingly, the invention is not limited to any particular air flow or direction for compression or vacuum and the exemplary embodiments are to be understood as merely illustrative.

As best shown in FIGS. 12-15, 20, and 21, each of the piston valves and lower exit or inlet valves is in the exemplary embodiments generally selectively openable through a floating disk that is biased against a surface having through-holes. To effectively seal those through-holes when the respective disk is shifted in the direction of the surface in which the through-holes are formed, it will be appreciated that, as shown, one or more o-rings are positioned in the appropriately sized and located retention channels so that such o-rings are squeezed between engaging surfaces and thereby form a relatively air-tight seal. Specifically, in the compressor piston-cylinder unit 30, a single o-ring 66 may be installed within a groove in either the piston base 44 or the valve disk 47, in either case, in the exemplary embodiments, the o-ring 66 being located radially outward of the through-holes 46 so as to achieve a sufficient seal, while in the vacuum pump piston-cylinder unit 70, the valve disk 87 is configured with two concentric grooves in which are seated two o-rings, the locations of the grooves and o-rings being respectively radially inward and outward of the through-holes 86 so as to bound and selectively seal the through-holes during operation. Numerous other configurations of such seals, and the o-rings particularly, including but not limited to the various other valve designs shown and described in the prior pending patent applications referred to above and incorporated herein by reference may also be employed, such that those skilled in the art will appreciate that the valves shown and described in the exemplary embodiments of the present invention are merely illustrative and that the invention is not so limited. Any of the disk valves employed in the present invention may be formed of glass-filled nylon, Delrin, aluminum, magnesium, or any other such suitable material now known or later developed. With regard to the clearance pocket, specifically, or the space between the piston and the lower valve when the piston reaches its full down stroke, or bottom-dead-center, position, the negative effects of such clearance pockets are further reduced in the exemplary embodiments of the present invention wherein the entire clearance pocket basically consists of a counter-bore recess in either the lower valve or the lower end of the piston rod formed to accommodate the head of the respective bolt holding the disk valve of either the piston, in the case of the compressor unit, or the lower inlet valve, in the case of the vacuum pump unit. In either case, the greatly reduced clearance pockets are made possible, at least in part, by having one valve on each surface. The clearance pocket ratio is further improved by virtue of favorable or relatively larger stroke-versus-diameter ratios for the various piston-cylinder arrangements. Regarding the piston rod itself, which is a flow path for air whether as the intake in the compression unit or the exhaust in the vacuum pump unit, it is formed in the exemplary embodiments of nominal 5/16" diameter chromolly steel, stainless steel, or aluminum alloy. While those skilled in the art will appreciate that the size and material of the rod is merely exemplary and that numerous other sizes may be employed to suit a particular application and numerous materials may be employed, both now known and later developed, it has been discovered that in certain embodiments or applications, a relatively smaller diameter piston rod, with all else being equal, has certain advantages in that the velocity of air through the rod, and thus the volume and pressure of air entering the upper chamber, is increased, thereby increasing the pre-charging or super-charging effect on the air before it is introduced into the lower chamber for compression, as described in more detail above. Similarly, for the vacuum pump unit, the relatively smaller diameter piston rod causes an increased velocity of the discharged air. In either case, the smaller diameter rod may also serve as a muffler and so minimize the noise from the inner workings of the piston-cylinder exiting through the rod to the atmosphere. Furthermore, as best seen in the same partial cross-sectional views of FIGS. 14, 15, 20, and 21 and particularly the schematic of FIG. 13, for example, the rod may be gimbaled in its installation within the piston, and the piston base, specifically, so as to allow the rod to float a bit and take out slight angular displacement of the rod rather than having resulting side load on the piston. That is, in the exemplary embodiment wherein the piston base sub-assembly 44 is formed with an upwardly-extending collar 45, an internal groove 58 may be formed within the collar 45 for the purpose of receiving an appropriately-sized o-ring 59, whereby the o-ring 59 facilitates installation of the piston rod 31 within the piston base sub-assembly 44 by seating or providing an interference fit therebetween and thus allowing for the piston rod to shift slightly in orientation relative to the piston base sub-assembly 44, and hence the piston body 42, so as to again decrease side load on the piston during use. Those skilled in the art will appreciate that the configurations of the channel 58 and o-ring 59 are merely exemplary and that numerous other configurations in gimbaling the rod within the piston base are possible without departing from the spirit and scope of the invention.

In sum, those skilled in the art will appreciate that even where the compressor or vacuum pump unit is single-acting and operates at a relatively slow rate, in such relatively low pressure and low flow applications, the required performance is yet obtained while the resulting system enjoys improved breathing, is less prone to vibration and blow-by problems, and is relatively inexpensive and uncomplicated to manufacture. Accordingly, it will be appreciated by those skilled in the art that the present invention is not limited to any particular configuration of a combination compressor and vacuum pump apparatus or method of use, much less the particular exemplary embodiments shown and described, and that numerous such configurations are possible without departing from the spirit and scope of the invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A combination compressor and vacuum pump apparatus comprising:

A common drive mechanism comprising:

A motor mounted within a frame of the apparatus, the motor having a common drive shaft; and At least two offset arms installed on the common drive shaft so as to be radially offset with respect to each other;

A compressor piston-cylinder unit mechanically coupled to the drive mechanism, the compressor piston-cylinder unit comprising a hollow first piston rod connected to a first of the at least two offset arms of the drive mechanism at a first free end substantially opposite a first piston operable within a first cylinder so as to form the compressor piston-cylinder unit; and A vacuum pump piston-cylinder unit mechanically coupled to the drive mechanism, the vacuum pump piston-cylinder unit comprising a hollow second piston rod connected to a second of the at least two offset arms of the drive mechanism at a second free end substantially opposite a second piston operable within a second cylinder so as to form the vacuum pump piston-cylinder unit, whereby the common drive mechanism serves to actuate the respective compressor and vacuum pump piston-cylinder units out of phase with one another so as to reduce the peak load on the motor, and further whereby upon such actuation air is pulled into the compressor piston-cylinder unit through the first piston rod for compression therein and air is exhausted from the vacuum pump piston-cylinder unit through the second piston rod.

2. The apparatus of claim 1 wherein the first and second pistons each comprise:

An annular piston body formed with at least one circumferential, spaced-apart, non-o-ring groove thereabout; and A piston base sub-assembly having the piston body installed thereon.

3. The apparatus of claim 2 wherein:

At least one channel is formed in an outer wall of the piston base sub-assembly; and An o-ring is seated in the at least one channel so as to secure the piston body on the piston base sub-assembly in a rooted fashion, whereby side load during operation of the piston within the cylinder is minimized and centering and even wear are encouraged.

4. The apparatus of claim 2 wherein:

The piston base sub-assembly is configured with an upwardly-extending collar having an internal groove formed therein;

An o-ring is seated in the internal groove; and

The piston rod is installed within the collar so as to engage the o-ring, whereby slight angular displacement of the piston rod relative to the piston base sub-assembly during use does not result in increased side load on the piston body.

5. The apparatus of claim 2 wherein the annular piston body is further formed with a substantially flat taper along at least a portion of its length.

6. The apparatus of claim 1 wherein the first and second pistons comprise:

A piston base sub-assembly having at least one through-hole;

A floating disk valve installed substantially adjacent to the piston base sub-assembly, the disk valve having at least one groove formed within a surface thereof substantially opposite the piston base-sub-assembly; and An o-ring seated within the at least one groove so as to selectively seal about the at least one through-hole.

7. The apparatus of claim 1 wherein the first and second pistons each comprise:

A piston base sub-assembly having at least one channel formed in an outer wall thereof; and An o-ring seated in the at least one channel so as to secure a piston body on the piston base sub-assembly in a rooted fashion, whereby side load during operation of the piston within the cylinder is minimized and centering and even wear are encouraged.

8. The apparatus of claim 2 wherein at least one of the piston-cylinder units further comprises a cylinder body having an upper end with an enlarged diameter stepped bore formed therein, whereby at least a portion of the annular piston body is free of contact with the cylinder body during actuation of the piston within the cylinder.

9. The apparatus of claim 2 wherein at least one of the piston-cylinder units further comprises:

A cylinder body having an upper end and a cylinder inside diameter; and

An upper cap installed on the cylinder body substantially at the upper end, the upper cap having a downwardly-extending skirt defining a cap inside diameter that is larger than the cylinder inside diameter, the cap skirt and cylinder body together defining the cylinder, whereby at least a portion of the annular piston body is free of contact with the cylinder body during actuation of the piston within the cylinder.

10. The apparatus of claim 1 wherein the offset arms are mounted on the common drive shaft so as to be radially offset with respect to each other such that the vacuum pump piston-cylinder unit lags the compressor piston-cylinder unit by approximately 30°.

11. The apparatus of claim 1 wherein:

Each piston-cylinder unit further comprises a pivoting base;

Each pivoting base is mounted to the frame via at least one pin; and

The pin associated with the compressor piston-cylinder unit base is offset from and off-line of the pin associated with the vacuum pump piston-cylinder unit base, whereby the out-of-phase common driving of the respective compressor and vacuum pump piston-cylinder units is further enhanced.

12. The apparatus of claim 5 wherein the taper is less than or equal to five thousandths of an inch.

* * * * *